US007683276B2

(12) United States Patent
Weister et al.

(10) Patent No.: US 7,683,276 B2
(45) Date of Patent: Mar. 23, 2010

(54) ELECTRICAL SWITCHING APPARATUS AND POLE SHAFT ASSEMBLY THEREFOR

(75) Inventors: Nathan J. Weister, Darlington, PA (US); William C. Pollitt, Murrysville, PA (US); Paul R. Rakus, Beaver Falls, PA (US); Ronald W. Brand, Beaver Falls, PA (US)

(73) Assignee: Eaton Corporation, Cleveland, OH (US)

( * ) Notice: Subject to any disclaimer, the term of this patent is extended or adjusted under 35 U.S.C. 154(b) by 365 days.

(21) Appl. No.: 11/742,774

(22) Filed: May 1, 2007

(65) Prior Publication Data

US 2008/0088093 A1 Apr. 17, 2008

Related U.S. Application Data

(63) Continuation-in-part of application No. 11/549,294, filed on Oct. 13, 2006, now Pat. No. 7,569,784.

(51) Int. Cl.
*H01H 77/00* (2006.01)

(52) U.S. Cl. ..... 200/244; 335/16; 218/22

(58) Field of Classification Search ..... 200/244, 200/250, 400, 401; 218/7, 14–22, 34, 152–154; 335/15, 16, 147, 190–195, 201, 202
See application file for complete search history.

(56) References Cited

U.S. PATENT DOCUMENTS 5,057,806 A 10/1991 McKee et al.
5,200,724 A 4/1993 Gula et al.
6,317,019 B1 11/2001 Herpin et al.
6,492,888 B2 * 12/2002 Dahl et al. ..... 335/202

* cited by examiner

*Primary Examiner*—Renee S Luebke
*Assistant Examiner*—Marina Fishman
(74) *Attorney, Agent, or Firm*—Martin J. Moran

(57) ABSTRACT

A pole shaft assembly for a circuit breaker includes a receiving portion disposed on the exterior side of the housing, a pole shaft pivotably disposed within the receiving portion and including at least one protrusion, a number of cover members overlaying the pole shaft and the receiving portion, at least one first seal disposed between the receiving portion and a corresponding protrusion, and at least one second seal disposed between such protrusion and a corresponding one of the cover members. The seals resist undesired entry of debris between the receiving portion and the pole shaft, and control the discharge of arc gases from the circuit breaker. The first seal is formed by the interaction between the receiving portion and the corresponding protrusion. The second seal is formed by the interaction between the protrusion and the corresponding one of the cover members.

4 Claims, 12 Drawing Sheets

ELECTRICAL SWITCHING APPARATUS AND POLE SHAFT ASSEMBLY THEREFOR

This application is a continuation-in-part of application Ser. No. 11/549,294, filed Oct. 13, 2006, now U.S. Pat. No. 7,569,784 and entitled "ELECTRICAL SWITCHING APPARATUS, AND HOUSING AND INTEGRAL POLE SHAFT BEARING ASSEMBLY THEREFOR".

CROSS-REFERENCE TO RELATED APPLICATIONS

This application is related to co-pending, commonly assigned:

U.S. patent application Ser. No. 11/549,316, filed Oct. 19, 2006, and entitled "ELECTRICAL SWITCHING APPARATUS, AND CARRIER ASSEMBLY AND INDEPENDENT PIVOT ASSEMBLY THEREFOR";

U.S. patent application Ser. No. 11/549,309, filed Oct. 19, 2006, and entitled "ELECTRICAL SWITCHING APPARATUS, AND MOVABLE CONTACT ASSEMBLY AND CONTACT SPRING ASSEMBLY THEREFOR"; and U.S. patent application Ser. No. 11/549,277, filed Oct. 19, 2006, and entitled "ELECTRICAL SWITCHING APPARATUS, AND CONDUCTOR ASSEMBLY, AND INDEPENDENT FLEXIBLE CONDUCTIVE ELEMENTS THEREFOR," all of which are hereby incorporated herein by reference.

BACKGROUND OF THE INVENTION

1. Field of the Invention

The invention relates generally to electrical switching apparatus and, more particularly, to pole shaft assemblies for electrical switching apparatus, such as circuit breakers.

2. Background Information

Electrical switching apparatus, such as circuit breakers, provide protection for electrical systems from electrical fault conditions such as, for example, current overloads, short circuits, abnormal voltage and other fault conditions. Typically, circuit breakers include an operating mechanism which opens electrical contact assemblies to interrupt the flow of current through the conductors of an electrical system in response to such fault conditions as detected, for example, by a trip unit.

Some low-voltage circuit breakers, for example, employ a molded housing having two parts, a first half or front part (e.g., a molded cover), and a second half or rear part (e.g., a molded base). The operating mechanism for such circuit breakers is often mounted to the front part of the housing, and typically includes an operating handle and/or button(s) which, at one end, is (are) accessible from the exterior of the molded housing and, at the other end, is (are) coupled to a pivotable pole shaft. Electrical contact assemblies, which are also disposed within the molded housing, generally comprise a conductor assembly including a movable contact assembly having a plurality of movable contacts, and a stationary contact assembly having a plurality of corresponding stationary contacts.

When the movable contacts are rapidly separated from the stationary contacts, for example, in response to an overload or short circuit condition, an arc is created which generates gas that is at least partially ionized, as well as debris such as, for example, plasma material, molten and/or vaporized metal, and/or combustion products, such as carbon. Openings or gaps, for example, between the pole shaft and the circuit breaker housing allow the gas and debris, which are electrically conductive, to escape. If enough of the electrically conductive gas and/or debris is/are discharged near an electrically conductive structure, unintended arcing can occur. Among other undesirable effects associated with such arcing, it can present an unsafe condition for any individual attempting to operate the circuit breaker. It can also cause damage to circuit breaker electronics, melt plastic parts, and it can undesirably weld moving parts of the operating mechanism together, preventing the operating mechanism from operating properly. The debris can also become lodged, for example, in grease joints, causing friction which further impedes the operation of the operating mechanism and can cause wear and tear that reduces the mechanical life of the operating mechanism components. Furthermore, the escaping gas tends to form a shock wave, the pressure of which can cause damage to components of the circuit breaker. Failure to control the gap between the pole shaft and the housing also makes it difficult to control pressure and gas flow in the arc chamber, which is important to circuit breaker performance.

There is, therefore, room for improvement in electrical switching apparatus, such as circuit breakers, and in pole shaft assemblies therefor.

SUMMARY OF THE INVENTION

These needs and others are met by embodiments of the invention, which are directed to a pole shaft assembly for electrical switching apparatus, such as circuit breakers, which pole shaft assembly is self-sealing to resist the undesired entry of debris and to control the pressure and flow of arc gases.

As one aspect of the invention, a pole shaft assembly is provided for an electrical switching apparatus including a housing having an exterior side, separable contacts enclosed by the housing, and an operating mechanism structured to open and close the separable contacts. The separable contacts are structured to create an arc that generates arc gases when the separable contacts open. The pole shaft assembly comprises: a receiving portion structured to be disposed on the exterior side of the housing; a pole shaft pivotably disposed within the receiving portion and including at least one protrusion; a number of cover members overlaying the pole shaft and the receiving portion; at least one first seal being disposed between the receiving portion and a corresponding one of such at least one protrusion; and at least one second seal disposed between at least one of such at least one protrusion and a corresponding one of the number of cover members. Such at least one first seal and such at least one second seal are structured to resist undesired entry of debris between the receiving portion and the pole shaft, and further to control the discharge of the arc gases from the electrical switching apparatus. Such at least one first seal is formed by the interaction between the receiving portion and the corresponding one of such at least one protrusion, and such at least one second seal is formed by the interaction between such at least one protrusion and the corresponding one of the number of cover members.

The electrical switching apparatus may further include a number of poles, and the pole shaft may be structured to extend perpendicularly across the number of poles. The number of poles may be a first pole, a second pole, and a third pole. The at least one protrusion of the pole shaft may be a first lobe extending outwardly from the pole shaft at the first pole, a second lobe extending outwardly from the pole shaft at the second pole, and a third lobe extending outwardly from the pole shaft at the third pole. Each of the first lobe, the second lobe, and the third lobe may include a surface. The receiving portion may comprise a first surface at the first pole, a second surface at the second pole, and a third surface at the third pole. The number of cover members may be a plurality of covers wherein a first one of the covers overlays the first lobe of the pole shaft at or about the first pole and includes a surface, and wherein a second one of the covers overlays the third lobe of the pole shaft at or about the third pole and includes a surface. The at least one first seal may be a primary seal for the first pole, a primary seal for the second pole, and a primary seal for the third pole, and the at least one second seal may be a secondary seal for the first pole and a secondary seal for the third pole. The primary seal of the first pole may be disposed between the surface of the first lobe and the first surface of the receiving portion, and the secondary seal of the first pole may be disposed between the surface of the first lobe and the surface of the first one of the covers. The primary seal of the second pole may be disposed between the surface of the second lobe and the second surface of the receiving portion. The primary seal of the third pole may be disposed between the surface of the third lobe and the third surface of the receiving portion, and the secondary seal of the third pole may be disposed between the surface of the third lobe and the surface of the second one of the covers.

As another aspect of the invention, an electrical switching apparatus comprises: a housing including an exterior side; separable contacts enclosed by the housing; an operating mechanism structured to open and close the separable contacts, which are structured to create an arc that generates arc gases when the separable contacts open; and a pole shaft assembly comprising: a receiving portion disposed on the exterior side of the housing, a pole shaft pivotably disposed within the receiving portion and including at least one protrusion, a number of cover members overlaying the pole shaft, at least one first seal being disposed between the receiving portion and a corresponding one of such at least one protrusion, and at least one second seal disposed between at least one of such at least one protrusion and a corresponding one of the number of cover members. Such at least one first seal and such at least one second seal resist undesired entry of debris between the receiving portion and the pole shaft, and control the discharge of the arc gases from the electrical switching apparatus. Such at least one first seal is formed by the interaction between the receiving portion and the corresponding one of such at least one protrusion, and such at least one second seal is formed by the interaction between such at least one protrusion and the corresponding one of the number of cover members.

The electrical switching apparatus may be a circuit breaker, wherein the receiving portion of the pole shaft assembly is a molded recess in the exterior side of the housing of the circuit breaker. The pole shaft of the pole shaft assembly may be a single-piece of material pivotably coupled to the housing at or about the molded recess. The at least one protrusion may be a plurality of lobes extending outwardly from the pole shaft and toward engagement with a corresponding surface of the molded recess, wherein each of the lobes may comprise a different segment of the single-piece of material.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
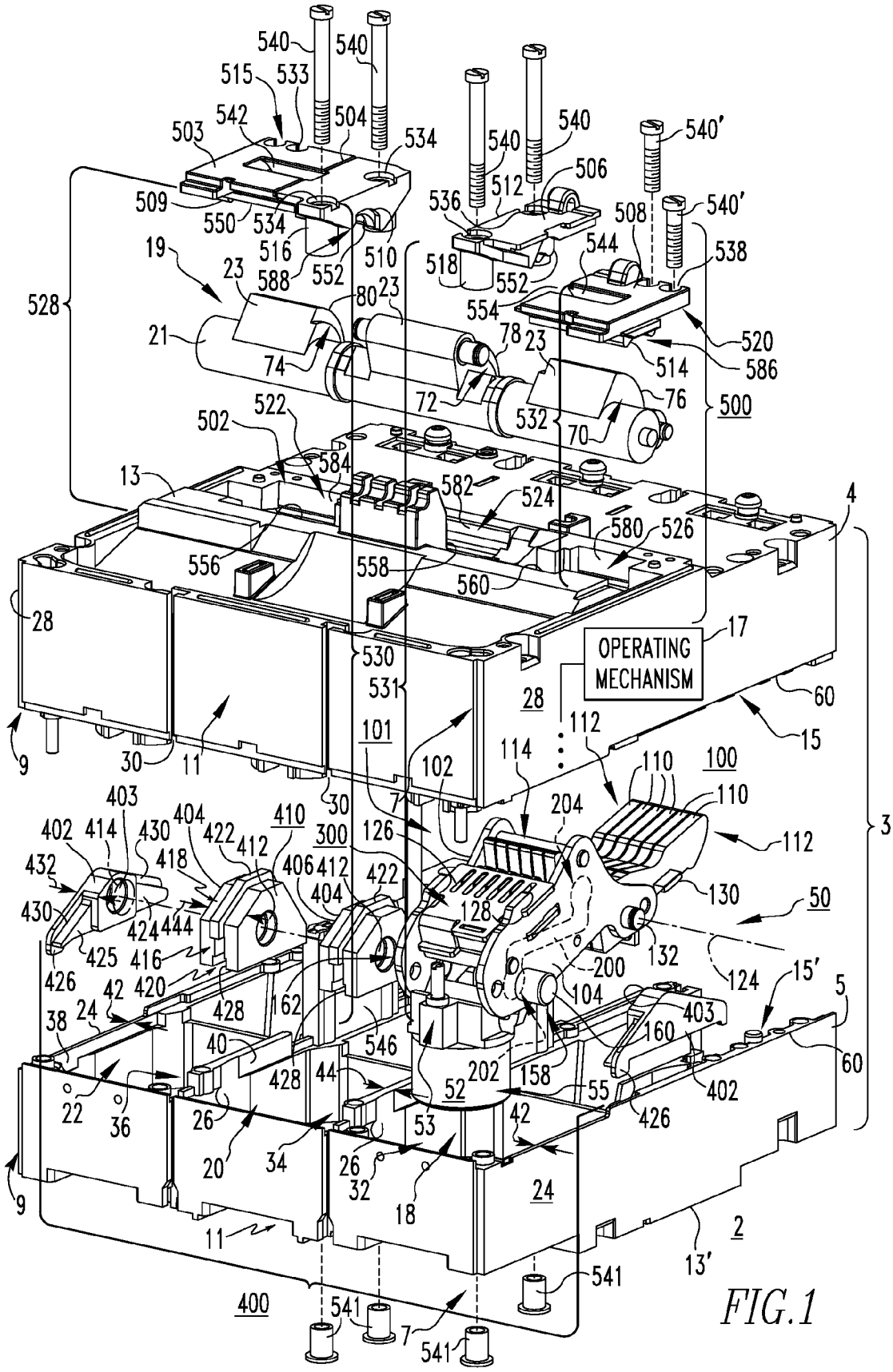
FIG. 1 is an exploded isometric view of a circuit breaker and pole shaft assembly therefor, in accordance with an embodiment of the invention.

For purposes of illustration, embodiments of the invention will be described as applied to low-voltage circuit breakers, although it will become apparent that they could also be applied to a wide variety of electrical switching apparatus (e.g., without limitation, circuit switching devices and other circuit interrupters, such as contactors, motor starters, motor controllers and other load controllers) other than low-voltage circuit breakers and other than low-voltage electrical switching apparatus.

Directional phrases used herein, such as, for example, left, right, clockwise, counterclockwise and derivatives thereof, relate to the orientation of the elements shown in the drawings and are not limiting upon the claims unless expressly recited therein.

As employed herein, the term "parting line" refers to the line which is created between sections of the mold which is used as part of the molding process for producing a molded component such as, for example and without limitation, the molded cover and molded base of the housing of the circuit breaker shown and described herein. Dimensional and tolerance variations occur across the parting line, such that one portion or section of the molded component on one side of the parting line is not in the desired precise orientation with respect to another portion or section on the other side of the parting line. For example and without limitation, the example parting lines discussed herein are defined between the respective interior surfaces or sides and the exterior surfaces or sides of the molded cover and molded base of the circuit breaker housing.

As employed herein, the term "mating line" refers to the junction or interface between two adjacent, separate components such as, for example and without limitation, the mating line defined by the junction of the molded cover of the example circuit breaker housing with the molded base of the circuit breaker housing.

As employed herein, the statement that two or more parts are "coupled" together shall mean that the parts are joined together either directly or joined through one or more intermediate parts.

As employed herein, the term "fastener" refers to any suitable connecting or tightening mechanism expressly including, but not limited to, screws, bolts and the combinations of bolts and nuts (e.g., without limitation, lock nuts) and bolts, washers and nuts.

As employed herein, the term "number" shall mean one or an integer greater than one (i.e., a plurality).

FIG. 1 shows a low-voltage circuit breaker 2 including a housing 3 which encloses a conductor assembly 50 having a movable contact assembly 100 with flexible conductive elements 200 (one flexible element 200 is shown in hidden line drawing in simplified form in FIG. 1), in accordance with embodiments of the invention. The housing 3 includes a first half or front part 4 (e.g., a molded cover) and a second half or back part 5 (e.g., a molded base), with the conductor assembly 50 being disposed therebetween. The low-voltage circuit breaker 2 further includes first and second conductors such as the example line and load conductors 6, 8 partially shown in phantom line drawing in simplified form in FIG. 3.

Figure 2:
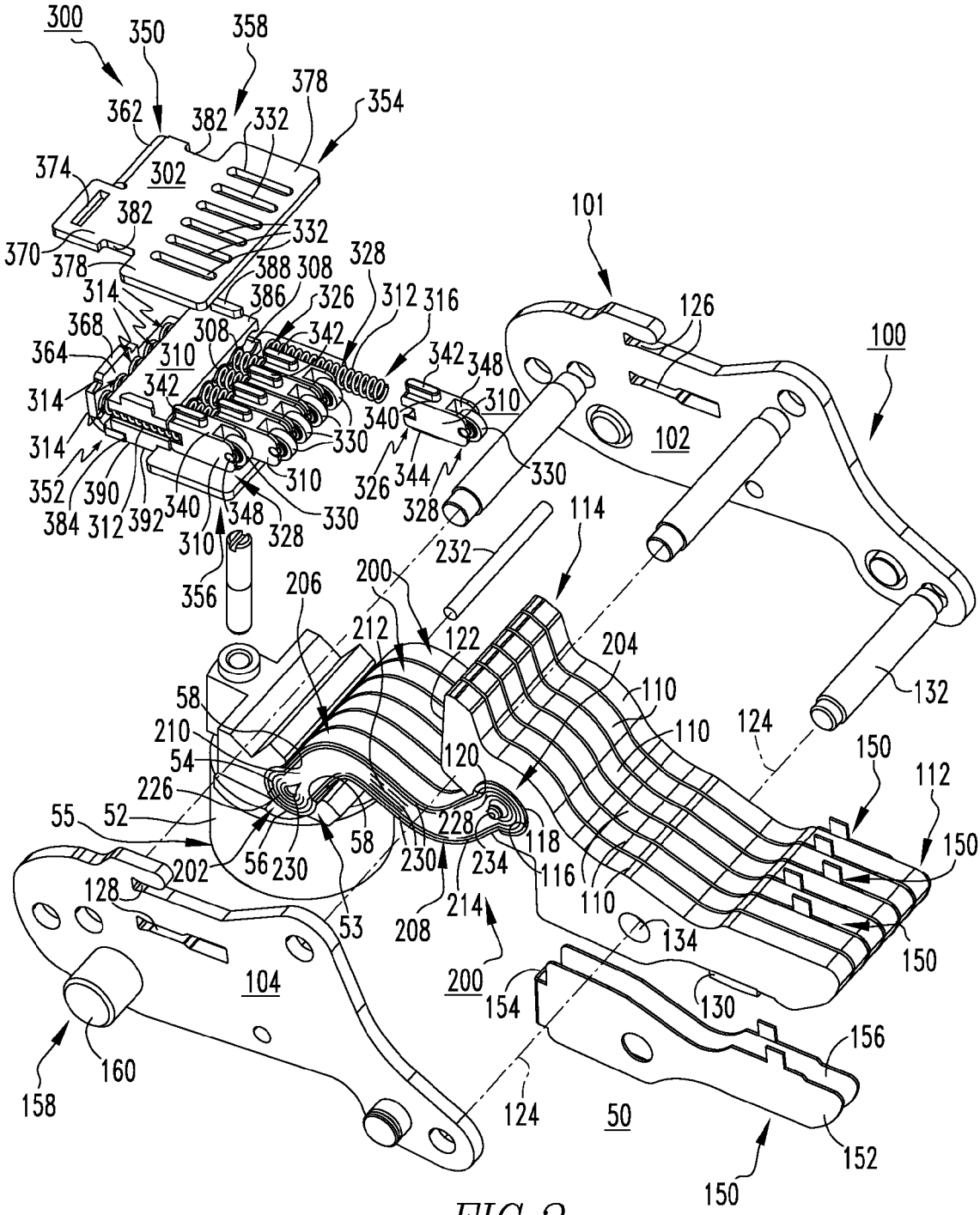
FIG. 2 is an exploded isometric view of the conductor assembly for the circuit breaker of FIG. 1.
Figure 3:
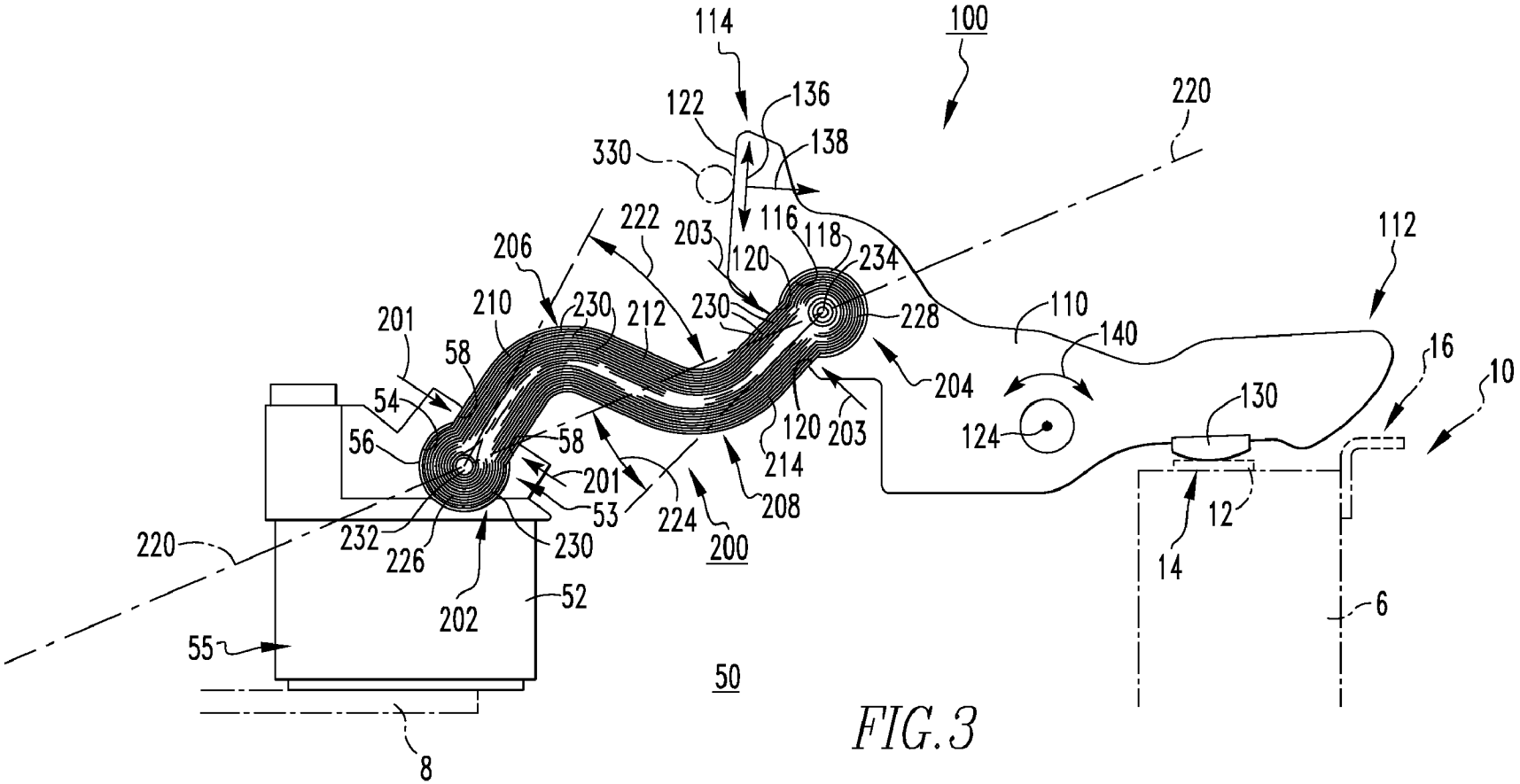
FIG. 3 is a side elevation view of a portion of the conductor assembly of FIG. 2.

As shown in FIGS. 2 and 3, the conductor assembly 50 includes a load conductor 52, a movable contact assembly 100, and a plurality of the flexible conductive elements 200 electrically connecting the load conductor 52 and the movable contact assembly 100. The movable contact assembly 100 includes a plurality of movable contact arms 110. Each of the movable contact arms 110 has a first end 112 and a second end 114. A movable electrical contact 130 is coupled to each movable contact arm 110 at or about the first end 112 thereof, and is structured to move into and out of electrical contact with a corresponding stationary electrical contact 12 (FIG. 3) of the low-voltage circuit breaker 2 (FIG. 1). Specifically, as shown in FIG. 3, the first electrical conductor or line conductor 6 of the circuit breaker 2 (FIG. 1) includes a stationary contact assembly 10 (shown in phantom line drawing in simplified form) having a plurality of stationary electrical contacts 12 (one stationary electrical contact 12 is shown in FIG. 3).

When the conductor assembly 50 is assembled within the circuit breaker housing 3 (FIG. 1) the load conductor 52 is in electrical contact with the second electrical conductor or load conductor 8 of the circuit breaker 2 and the movable electrical contact 130 is movable into (FIG. 3) and out of (not shown) electrical contact with the corresponding stationary electrical contact 12 of the stationary contact assembly 10. It will be appreciated that, for simplicity of illustration, only one conductor assembly 50 is shown in the figures. Typically, however, the low-voltage circuit breaker 2, shown in FIG. 1, which is a three-pole circuit breaker 2, would include three such conductor assemblies 50, one for each of the poles of the circuit breaker 2. It will further be appreciated that the conductor assembly 50 could be employed with any known or suitable electrical switching apparatus having any number of poles other than the three-pole low-voltage circuit breaker 2 shown and described in connection with FIG. 1.

Referring to FIGS. 2 and 3, each of the flexible conductive elements 200 which electrically connect the load conductor 52 of the conductor assembly 50 to the movable contact assembly 100, includes a first end 202 structured to be electrically connected to the load conductor 52, a second end 204 structured to be electrically connected to a corresponding one of the movable contact arms 110 of the movable contact assembly 100, and a plurality of bends 206,208 between the first end 202 and the second end 204. As best shown in FIG. 3, a first one of the bends 206 is in a first direction and at least a second one of the bends 208 is in a second direction which is generally opposite the first direction of the first bend 206. More specifically, the example flexible conductive element 200 is a shunt comprising layered conductive ribbon 230 (shown exaggerated in FIGS. 2 and 3 for ease of illustration), and includes two bends 206,208, a first bend 206 in the first direction, and a second bend 208 in the second direction in order that the shunt 200 is generally S-shaped. Accordingly, the shunt 200 includes a first portion 210 disposed between the first end 202 and the first bend 206, a second portion 212 disposed between first bend 206 and second bend 208, and a third portion 214 disposed between second bend 208 and the second end 204 of the shunt 200. The generally S-shape configuration of the shunt 200 permits it to have a relatively low profile in a vertical direction, thus minimizing the amount of space required for the conductor assembly 50 within the circuit breaker housing 2 (FIG. 1).

An axis 220 extends between the first end 202 of the shunt 200 and the second end 204 of the shunt 200. The first portion 210 of the shunt 200 forms a first angle 222 with respect to axis 220 on one side of the axis, and the third portion 214 of the shunt 200 forms a second angle 224 with respect to the axis 220, on the opposite side of the axis 220. Preferably the first and second angles 222,224 of the first and third portions 210,214 of shunt 200, are different. For example, the first angle 222 of the shunt 200 of FIG. 3 is greater than second angle 224. By way of a non-limiting example, the first angle 222 of the example shunt 200 is between about 26 degrees and about 36 degrees with respect to axis 220, and the second angle 224 is between about 11 degrees and about 22 degrees. It will, however, be appreciated that any known or suitable shunt configuration could be employed in accordance with embodiments of the invention to accommodate the compound motion of the conductor assembly 50 while minimizing areas of stress concentration in the shunts 200 and providing a compact shunt design. It will also be appreciated that while the shunt 200 is contemplated as being made from wound layered conductive ribbon 230 which is made of copper, that any known or suitable electrically conductive material could alternatively be employed without departing from the scope of the invention. Likewise, while the example shunt 200 has about 58 layers of conductive ribbon 230, a width of about 0.35 inches, a length of about 2.2 inches (measured from the center of the first end 202 of shunt 200 to the center of the second end 204 thereof), an overall thickness of about 0.187 inches, and a ribbon layer thickness of about 0.003 inches, it will be appreciated that one or more of these dimensions could be changed to any known or suitable value as necessary for the particular application in which the shunt 200 will be used.

Continuing to refer to FIGS. 2 and 3, the load conductor 52 of the conductor assembly 50 comprises a solid conductor 52 having a first portion 53 and a second portion 55 generally opposite the first portion 53. The first portion 53 includes a first aperture which generally comprises a single elongated recess 54 (best shown in FIG. 2). The single elongated recess 54 receives the first ends 202 of all of the shunts 200. The second ends 204 of the shunts 200 are received in corresponding second apertures 116 in the second ends 114 of each of the movable contact arms 110 (six shunts 200 are shown in FIG. 2). More specifically, the first end 202 of each shunt 200 comprises a first generally round head 226 and the second end 204 of the shunt 200 comprises a second generally round head 228. The single elongated recess 54 of the load conductor 52 and the second aperture 116 of the corresponding movable contact arms 110 each comprise an interior arcuate portion 56,118 and a neck portion 58,120, respectively, as shown. The first generally round head 226 of the first end 202 of shunt 200 is disposed within the interior arcuate portion 56 of the first aperture or single elongated recess 54 of the load conductor 52, as shown, and the neck portion 58 of the first aperture 54 is compressed against shunt 200 in the direction indicated by arrows 201 of FIG. 3 in order to retain the first end 202 of the shunt 200 within the first aperture 54. Similarly, the second generally round head 228 is disposed within the second aperture 116 of the corresponding movable contact arm 110, and the second end 204 of the shunt 200 is retained within the interior arcuate portion 118 of the second aperture 116. Such retention can be provided by the neck portion 120 of the second aperture 116 being compressed against the shunt 200 in the direction generally indicated by arrows 203 of FIG. 3, but may further or alternatively be provided by a pin 234 being inserted through the round head 228 (discussed hereinbelow) and then swaged or peened to expand the layers of conductive ribbon 230 of the second end 204 radially outward against the interior arcuate portion 118 of the second aperture 116.

For each of the example shunts 200, the first and second generally rounds heads 226,228 of the first and second ends 202,204 further include first and second pins 232,234 disposed through the center of the heads 226,228 within the first and second apertures 54,116, respectively. More specifically, the layers of conductive ribbon 230 of the shunt 200 wrap around the first and second pins 232,234 within the first and second apertures 54,116, respectively, of the load conductor 52 and the corresponding movable contact arm 110, respectively, as shown in FIG. 3.

In FIG. 2, the first pin 232 is shown before being inserted through the center of the first generally round head 226 of each of the shunts 200 within the interior arcuate portion 56 of the single elongated recess 54 of the load conductor 52. Accordingly, it will be appreciated that the first and second ends 202,204 of the shunts are secured within the first and second apertures 54,116, respectively, of the load conductor 52 and the corresponding movable contact arms 210. This may be accomplished by, for example and without limitation, swaging or crimping a portion (e.g., neck portion 58) of the load conductor 52 adjacent the first aperture 54, and a portion (e.g., neck portion 120) of the corresponding movable contact arm 110 adjacent the second aperture 116 against the first and second ends 202,204 of the shunts 200, respectively, or by any other known or suitable fastening process or mechanism, such as, for example, a rivet 232,234 (e.g., a staked or suitably deformed pin), solder, brazing, or any suitable combination thereof.

As best shown in FIG. 2, the movable contact assembly 100 may further include a plurality of spacers 150 structured to separate the movable contact arms 110 of the assembly 100 from one another. Specifically, each of the spacers 150 includes a first portion 152, a connection portion 154, and a second portion 156 spaced opposite from the first portion 152, as shown. Each of the movable contact arms 110 of the movable contact assembly 100 is disposed between the first and second portions 152,156 of one of the spacers 150, thereby separating one movable contact arm 110 from at least one other movable contact arm 110 of the movable contact assembly 100. The spacers 150 may be made from any known or suitable material, such as, for example and without limitation, vulcanized fiber material, commonly referred to as fish paper. It will be appreciated that the spacers 150 may, but need not necessarily, also serve to electrically and/or thermally insulate the movable contact arms 110 of the assembly 100 from one another.

In addition to the aforementioned flexible conductive members 200, FIG. 2 also shows a contact spring assembly 300 for the movable contact assembly 100 of conductor assembly 50. The movable contact assembly 100, previously discussed, further includes opposing first and second carrier members 102,104 which secure the movable contact arms 110 therebetween, thus comprising a carrier assembly 101. The contact spring assembly 300 is coupled to at least one of the first and second carrier members 102,104, and is disposed between the first and second carrier members 102,104 proximate the second ends 114 of the movable contact arms 110.

Referring to FIGS. 2, 4, 5, 6A, and 6B, the contact spring assembly 300 includes a first contact spring housing member 302 and a second contact spring housing member 304 coupled to the first contact spring housing member 302 and disposed opposite therefrom. A spring guide 306 is coupled to at least one of the first and second contact spring housing members 302,304, and is disposed therebetween. The spring guide 306 includes a plurality of spring holes 308 each structured to receive a corresponding spring 312. Specifically, each spring 312 has a first end 314, which is received by a corresponding one of the spring holes 308 of spring guide 306, and a second end 316, which is coupled to a corresponding slider 310 (best shown in FIGS. 2 and 5). Each of the springs 312 and sliders 310 coupled thereto is structured to individually bias a corresponding one of the movable contact arms 110 (FIGS. 1-4) of the movable contact assembly 100 (FIGS. 1-4) and the movable electrical contact 130 (FIGS. 1-3) coupled thereto towards engagement with a corresponding one of the stationary electrical contacts 12 (FIG. 3) of the stationary contact assembly 10 (FIG. 3).

The example first and second contact spring housing members 302,304 are substantially identical. Thus, the number of components which must be manufactured for the contact spring assembly 300 is reduced, thereby reducing the associated manufacturing costs. Additionally, the substantially identical first and second contact spring housing members 302,304 enable the contact spring assembly 300 to be secured together without requiring the use of conventional mechanical fasteners (e.g., without limitation, screws; rivets; bolts and nuts), as will be discussed in greater detail herein below.

Figure 4:
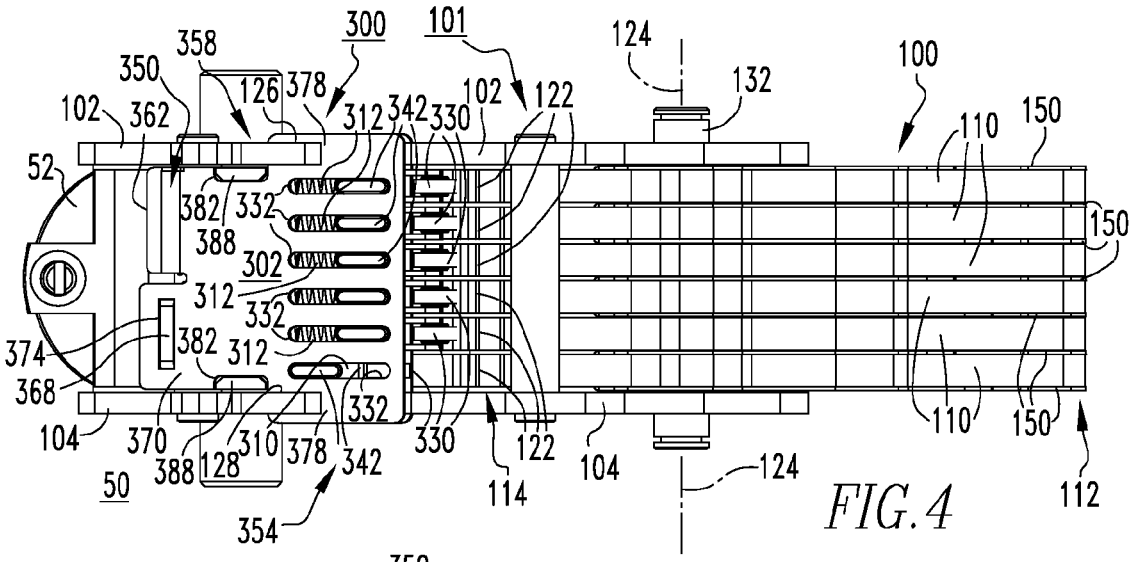
FIG. 4 is a top plan view of the conductor assembly of FIG. 2, including a self-contained contact spring assembly.
Figure 5:
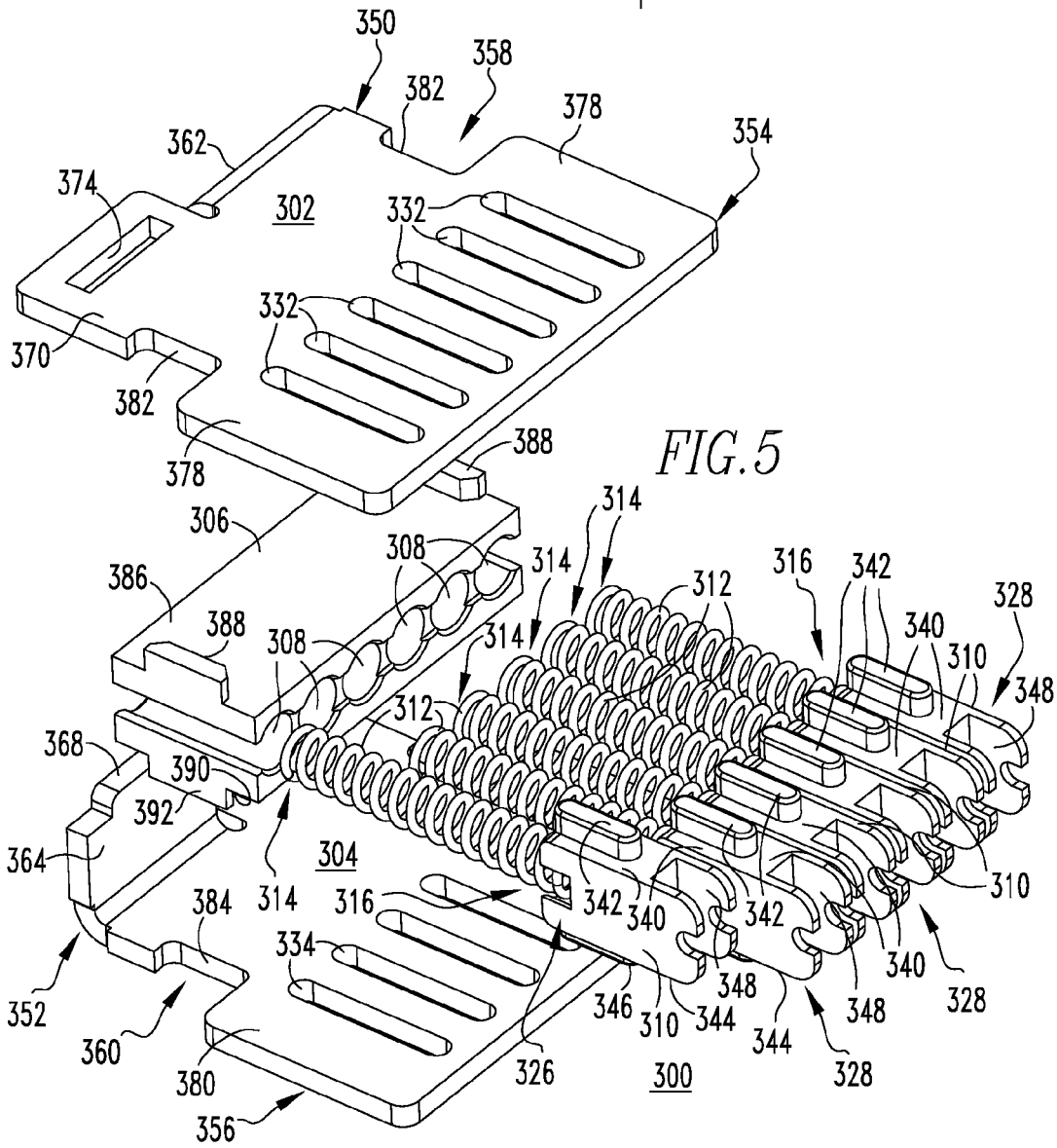
FIG. 5 is an exploded isometric view of the self-contained contact spring assembly of FIG. 4.

As shown in FIGS. 2 and 5, the example contact spring assembly 300 includes six springs 312 which are received in six corresponding spring thru holes 308 of the spring guide 306. The thru holes 308 (best shown in FIG. 5) extend completely through the spring guide 306, in order to receive the first ends 314 of the springs 312. As previously discussed, the second ends 316 of the springs 312 are coupled to individual sliders 310. Each slider 310 includes a first end 326 coupled to the second end 316 of a corresponding one of the springs 312, and a second end 328 comprising a cam element such as the rollers 330, best shown in FIGS. 2 and 4. Each of the cam elements 330 (FIGS. 2 and 4) is structured to engage and move a corresponding one of the movable contact arms 110 of the movable contact assembly 100.

Figure 6A:
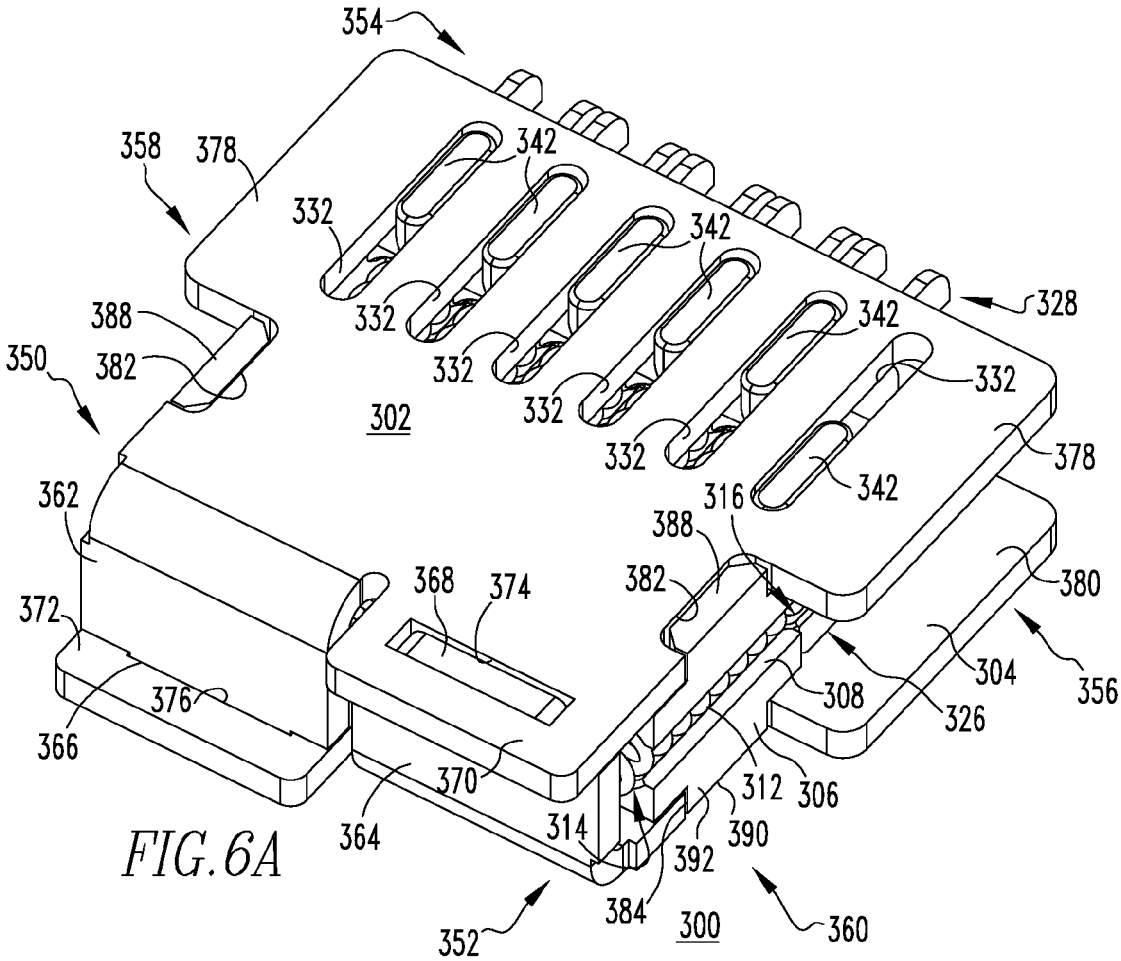
FIG. 6A is an assembled top isometric view of the self-contained contact spring assembly of FIG. 5.
Figure 6B:
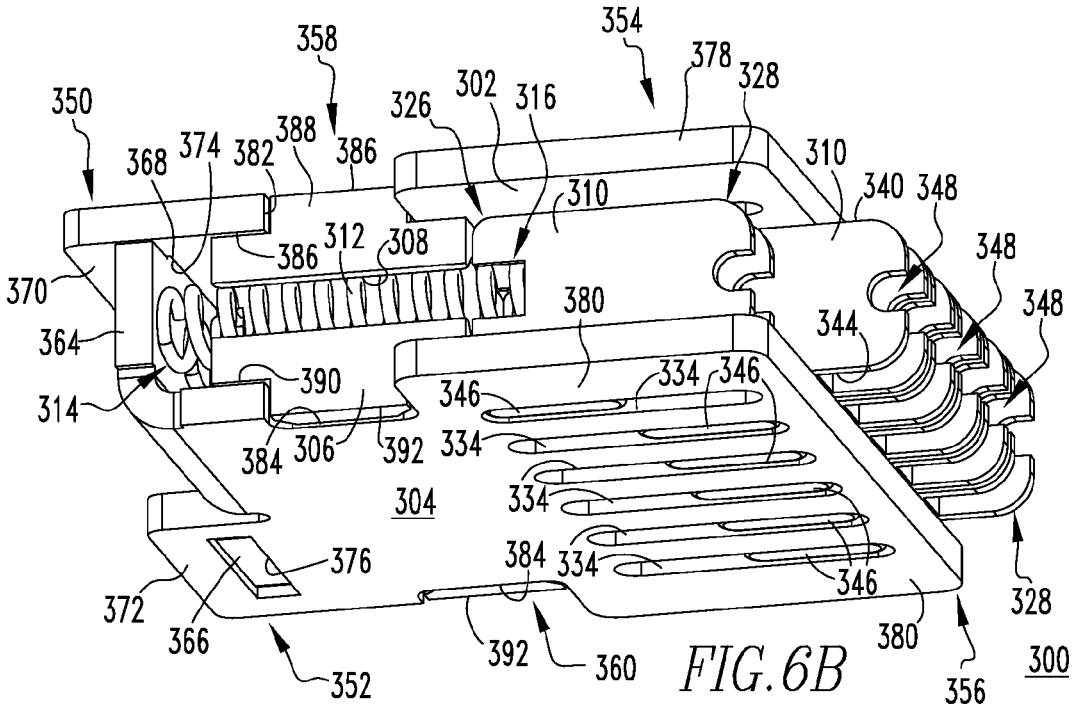
FIG. 6B is an assembled bottom isometric view of the self-contained contact spring assembly of FIG. 5.

Referring to FIGS. 5, 6A and 6B, the first and second contact spring housing members 302,304 of the contact spring assembly 300 each include a plurality of elongated guide slots 332,334 for receiving first and second protrusions 342,346 on the first and second sides 340,344 of each slider 310. Specifically, the first and second protrusions 342,346 engage an opposing pair of the elongated guide slots 332,334 of the first and second spring housing members 302,304, respectively, in order to guide the slider 310 and cam element 330 (FIGS. 2 and 4) towards engagement with the corresponding movable contact arm 110 (FIGS. 2 and 4). For example, in FIG. 4, five of the cam elements 330 are extended and engaging the second ends 114 of corresponding movable contact arms 110 of the movable contact assembly 100. The sixth cam element 330 is retracted, as indicated by the position of the first protrusion 342 of slider 310 within the first guide slot 332 of the first contact spring housing member 302. Accordingly, it will be appreciated that the cam elements 330 (FIGS. 2 and 4) of the contact spring assembly 300 in accordance with embodiments of the invention individually engage and bias a corresponding movable contact arm 110 (FIGS. 2 and 4) independent from the remainder of the cam elements 330 (FIGS. 2 and 4) of the contact spring assembly 300. It will be appreciated that the cam elements 330 can comprise any known or suitable bearing element, such as the small wheel 330 shown in FIG. 2, which is pivotably disposed within a recess 348 at the second end 328 of slider 310.

As previously noted, the contact spring assembly 300 is secured together and to the carrier assembly 101 (FIG. 2), without requiring the use of separate mechanical fasteners. More specifically, as best shown in FIGS. 5, 6A and 6B, the first and second contact spring housing members 302,304 each include at least one protrusion 366,368 and at least one aperture 374,376, wherein the first and second contact spring housing members 302,304 are positioned in order that the protrusion 366,368 of one of the first and second contact spring carrier members 302,304 engages the aperture 374, 376 of the other of the first and second contact spring carrier member 302,304, respectively, thereby securing the contact spring assembly 300 together. More specifically, the first and second contact spring housing members 302,304 each include a first end 350,352 and a second end 354,356, respectively. The first end 350,352 includes a folded tab 362,364 including the protrusion 366,368, and an unfolded tab 370, 372 having the aperture 374,376. The relationship between the first and second contact spring housing members 302,304 which, as previously discussed, are substantially identical, can best be appreciated with reference to the front and back isometric views of the contact spring assembly 300 shown in FIGS. 6A and 6B, respectively. Specifically, protrusion 366 of the folded tab 362 of the first end 350 of first contact spring housing member 302 engages the aperture 376 of the unfolded tab 372 of the first end 352 of second contact spring housing member 304, and protrusion 368 of the folded tab 364 of the first end 352 of second contact spring housing member 304 engages the aperture 374 of the unfolded tab 370 of the first end 350 of first contact spring housing member 302.

The second ends 354,356 of the first and second contact spring housing members 302,304 each comprise a pair of lateral protrusions 378,380 which, as best shown in FIGS. 2 and 4, are structured to engage corresponding slots 126,128 in the first and second carrier members 102,104 of the carrier assembly 101 of movable contact assembly 100. More specifically, the pair of lateral protrusions 378,380 of the second end 354,356 of one of the first and second contact spring housing members 302,304 engages corresponding slots 126, 128 in the first and second carrier members 102,104, respectively, of the carrier assembly 101, thereby securely coupling the contact spring assembly 300 to the movable contact assembly 100, without the use of separate mechanical fasteners.

The first and second contact spring housing members 302, 304 also include an intermediate portion 358,360 having a pair of recesses 382,384, respectively. The recesses 382,384 are engaged by corresponding first and second pairs of protrusions 388,392 on the first and second sides 386,390, respectively, of the spring guide 306.

As shown in FIGS. 1, 2, and 4, the movable contact arms 110 of the movable contact assembly 100 have an axis of a rotation 124. The axis of a rotation 124 extends generally perpendicularly with respect to the first and second carrier members 102,104 of the carrier assembly 101. More specifically, the movable contact arms 110 pivot clockwise and counterclockwise (from the perspective of FIGS. 1 and 2) about a pivot pin 132, which extends through a corresponding aperture 134 (FIG. 2) in each of the movable contact arms 110. The contact spring assembly 300 is coupled to the movable contact assembly 100, in the manner previously discussed, at a location which is above and behind the axis of rotation 124. This location, which is proximate the second ends 114 of the movable contact arms 110 of the movable contact assembly 100, provides the springs 312 of the contact spring assembly 300 with a mechanical advantage by placing them at a location (e.g., above and behind) which facilitates pivotal movement of the movable contact arms 110 about the aforementioned axis of a rotation 124. More specifically, the second end 114 of each movable contact arm 110 includes a cam profile 122 (FIGS. 2-4). In operation, the roller cam element 330 (FIGS. 2-4) of each slider 310 (FIGS. 2, 4, 5, 6A and 6B) of the contact spring assembly 300 (FIGS. 1, 2, 4, 5, 6A and 6B) engages the cam profile 122 of a corresponding one of the movable contact arms 110. In turn, as shown in FIG. 3, the roller cam element 330 (shown in phantom line drawing in simplified form in FIG. 3) rolls along the cam profile 122 in the direction generally indicated by arrow 136 of FIG. 3 as it biases the second end 114 of the movable contact arm 110 in the direction generally indicated by arrow 138 of FIG. 3, causing the movable contact arm 110 to pivot clockwise (from the perspective of FIG. 3) about axis of rotation 124 as generally indicated by arrow 140 of FIG. 3. In this manner, movable electrical contact 130 of the movable contact arm 110 is pivoted toward electrical contact with stationary electrical contact 12 of the stationary contact assembly 10. It will be appreciated that the cam profile 122 could have any known or suitable shape in order to provide the desired movable contact arm 110 motion.

The example stationary contact assembly 10, which is shown in phantom line drawing in simplified form in FIG. 3, includes a first contact portion 14 which is engaged by movable electrical contact 130 on movable contact arm 110, as shown. It will, however, be appreciated that the stationary contact assembly 10 could have any known or suitable alternative configuration. For example and without limitation, it could further include a second contact portion 16, as shown in phantom line drawing in simplified form in FIG. 3. It will also be appreciated that the first end 112 of the movable contact arm 110 could include, for example, a toe portion 106 and a heel portion 108, with the movable electrical contact 130 being mounted on the heel portion 108, as shown. The movable electrical contact 130 at or about the heel portion 108 is movable into and out of electrical contact with the stationary electrical contact 12 of first contact portion 14 of the stationary contact assembly 10, and the toe portion 106 is movable into (not shown) and out of (as shown) electrical contact with the second contact portion 16 of the stationary contact assembly 10. This movable and stationary electrical contact interaction is commonly referred to in the art as a "heel-toe" contact configuration, and is generally well known. Thus, the contact spring assembly 300 facilitates movement of the movable contact assembly 100 which is controlled by the circuit breaker operating mechanism (shown in simplified form in FIG. 1), in any suitable well known manner.

Referring to FIGS. 1 and 7-11, a pivot assembly 400 for the carrier assemblies 101 (FIGS. 1 and 9) of the low-voltage circuit breaker 2 (FIGS. 1, 9 and 10) is shown. The pivot assembly 400 comprises a plurality of pivot members 402, 404 which are separate independent components from the circuit breaker housing 3 (FIGS. 1 and 9-11). The pivot member 402,404 are structured to be clam-shelled between the molded cover 4 (FIGS. 1 and 9-10) and the molded base 5 (FIGS. 1, 9 and 10) of the circuit breaker housing 3, in order to improve the accuracy with which the carrier assembly 101 and components thereof (e.g., without limitation, movable contact assembly 100) are mounted within the circuit breaker 2.

Figure 9:
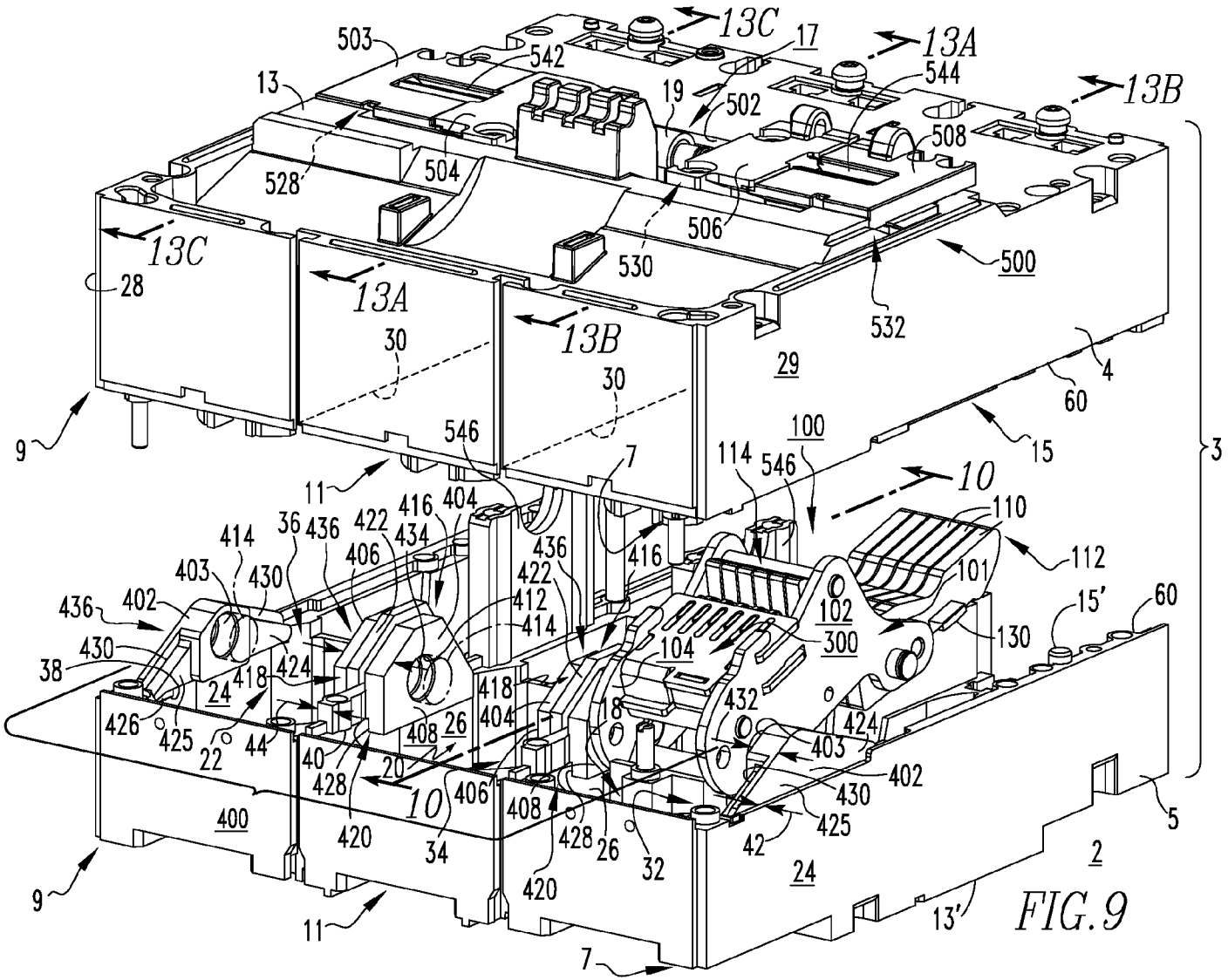
FIG. 9 is a partially assembled isometric view of the circuit breaker and pole shaft assembly therefor, of FIG. 1.

As best shown in FIG. 9, each of the pivot members 402, 404 includes an aperture 403,408,412 structured to receive a suitable pivot 158 of the carrier assembly 101 (FIG. 2) in order that it is pivotably coupled between a corresponding pair of the pivot members, such as 402,404, as shown. The pivot 158 may comprise any suitable pivot such as, for example and without limitation, at least one pivot pin, such as the first and second pivot pins 160,162 extending outwardly, generally perpendicularly from the first and second carrier members 102,104 of the carrier assembly 101 in FIG. 4.

Figure 7:
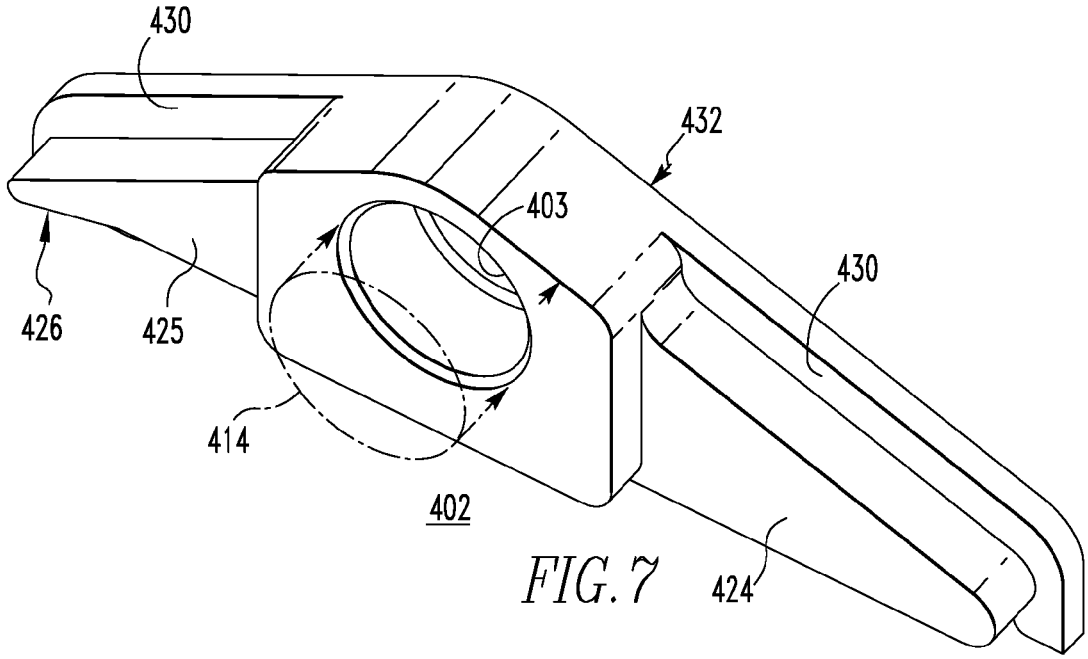
FIG. 7 is an isometric view of one component of the independent carrier assembly of FIG. 1.
Figure 8:
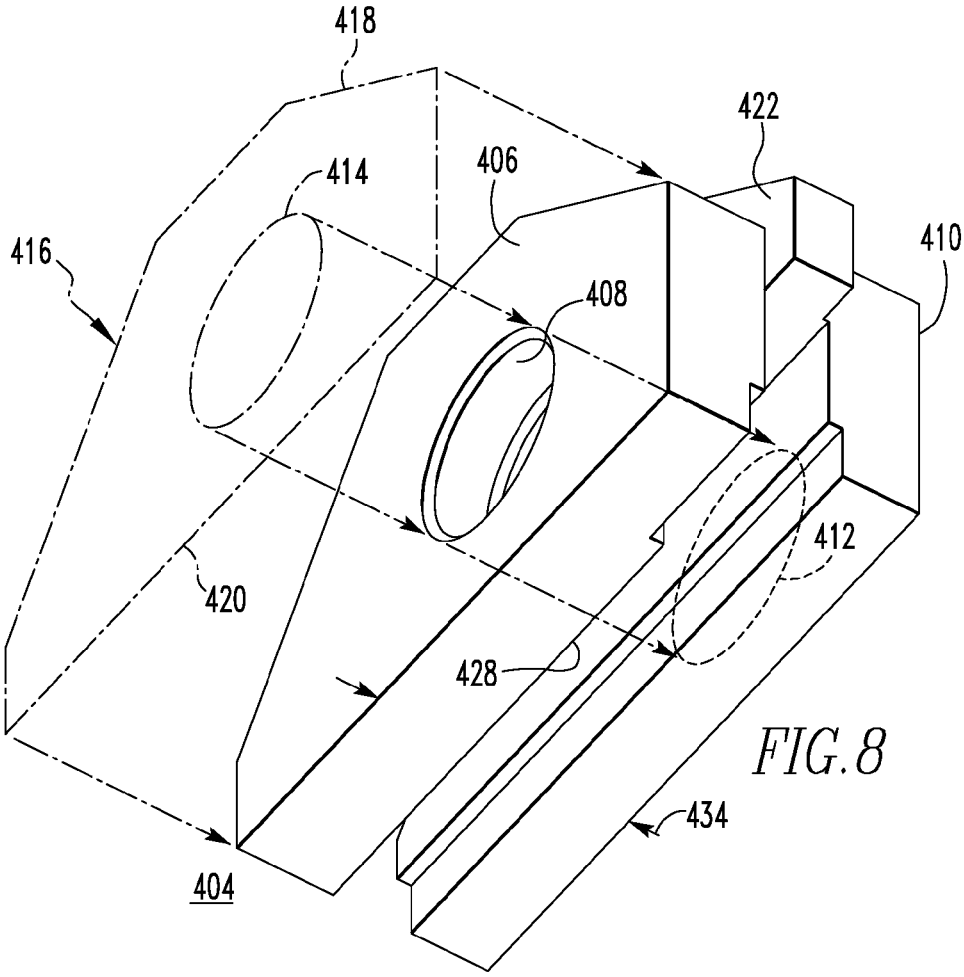
FIG. 8 is an isometric view of another component of the independent carrier assembly of FIG. 1.
Figure 10:
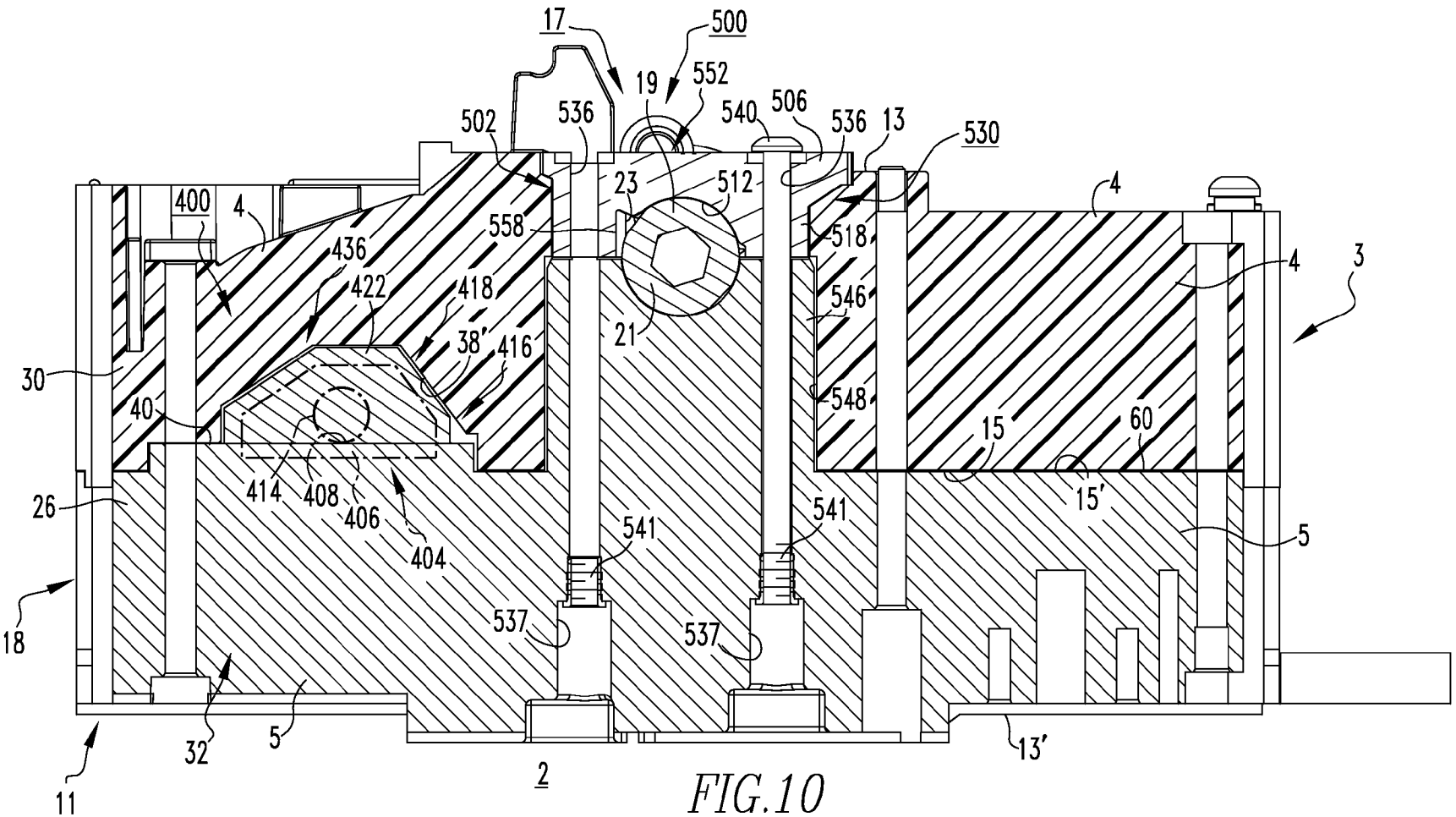
FIG. 10 is an assembled side elevation cross-sectional view of the circuit breaker and pole shaft assembly therefor, of FIG. 1.

FIGS. 7 and 8 respectively show the two types of pivot members 402 and 404 which comprise the example pivot assembly 400 (FIGS. 1, 9 and 10). More specifically, each of the one-piece molded pivot members 402,404 includes the aperture 403 (FIG. 7), 408 (FIG. 8), 412 (shown in hidden line drawing in FIGS. 8 and 10; see also FIG. 9) which is a substantially circular pivot recess 403 (FIG. 7), 408 (FIG. 8), 412 (shown in hidden line drawing in FIGS. 8 and 10; see also FIG. 9) having a full, continuous circumference 414.

End pivot member 402 of FIG. 7 includes a pair of lateral extensions 424,425 which extend outwardly from the pivot recess 403. In the example shown and described herein, at least one of the lateral extensions 424,425 includes at least one protrusion, such as the single tab 426 (best shown in FIG. 7) extending generally perpendicularly from lateral extension 425 of the pivot member 402. Each of the end pivot members 402 in the example shown and described, also includes at least one cut-out portion, such as, for example and without limitation, the pair of cut-out portions 430 in each of the lateral extensions 424,425 of the example end pivot member 402, shown. Each end pivot member 402 also has a width 432 which, as will be discussed hereinbelow, is equal to or greater than the width of the walls 24,26,28,30 (FIGS. 1 and 9) of the circuit breaker housing 3 (FIG. 1, and FIGS. 9-11). It will, however, be appreciated that the end pivot members 402 of the pivot assembly 400 (FIGS. 1, 9, and 10) could comprise any known or suitable alternative configuration and number of recesses and protrusions other than those shown and described herein, without departing from the scope of the invention. For example and without limitation, the pivot members 402 could alternatively have a combination (not shown) of protrusions but no recesses, or a combination (not shown) of recesses but no protrusions.

FIG. 8 shows an intermediate pivot member 404 of the pivot assembly 400 (FIGS. 1, 9, and 10). Each of the intermediate pivot members 404 has a perimeter 416 with at least one protrusion such as, for example, rib 422, which extends outwardly from a first portion 418 of the perimeter 416, and at least one recess such as, for example, elongated recess 428, within a second portion 420 of the perimeter 416. The rib 422 and elongated recess 428, like the aforementioned tab 426 and cut-out portions 430 of end pivot member 402 discussed in connection with FIG. 7, function to secure the pivot member 404 between the molded cover 4 and molded base 5 of the circuit breaker housing 3, as will be discussed in greater detail hereinbelow, for example with respect to FIG. 10. Like end pivot member 402, intermediate pivot member 404 is a one-piece molded member having a first pivot recess 408 in the first side 406 thereof, wherein the first pivot recess 408 has a full, continuous diameter 414. However, unlike end pivot member 402, each of the intermediate pivot members 404 further includes a second side 410 having a second pivot recess 412 (see, for example, FIG. 9). In this manner, in operation, each intermediate pivot member 404 receives and pivotably secures the pivot members 158 (FIG. 1) of two different carrier assemblies 101 (one carrier assembly 101 is shown in FIG. 1, for ease of illustration), one on the first side 406 and the other on the second side 410 of the intermediate pivot member 404.

At least one of the protrusions 422,426 of the respective pivot members 404,402 is structured to engage one of the molded cover 4 and the molded base 5 of the circuit breaker housing 3, and at least one of the cut-out portions 428,430 of the respective pivot members 404,402 is structured to engage the other of the molded cover 4 and molded base 5 in order to clam-shell the pivot members 402,404 therebetween, as previously discussed.

As employed herein, the term "clam-shell" refer to the nature in which the pivot members 402,404 are secured (e.g., sandwiched) between the molded cover 4 and molded base 5 of the circuit breaker housing 3, without requiring the use of separate fasteners. More specifically, as shown in FIG. 9, the circuit breaker 2 has a plurality of poles 18,20,22, and includes a carrier assembly 101 for each of these poles (one carrier assembly 101 is shown for simplicity of illustration). The circuit breaker housing 3 comprises a plurality of substantially vertical walls 24,26 and 28,30 molded in the molded base 5 and molded cover 4, respectively, of the circuit breaker housing 3. When the molded cover 4 and molded base 5 are assembled, as shown in FIG. 10, each of the substantially vertically walls 24,26 of the molded base 5 generally aligns with a corresponding one of the substantially vertical walls 28,30 of the molded cover 4 to form a plurality of separate cavities 32,34,36 for the poles 18,20,22 of the circuit breaker 2. Each of the aforementioned pivot members 402, 404 of the pivot assembly 400 is clam-shelled between the corresponding pair of substantially vertical walls 24,26 of the molded base 5 and the substantially vertical walls 28,30 of the molded cover 4, thereby providing substantially unobstructed access to the separate cavities 32,34,36 within the circuit breaker housing 3. In this manner, the pivot assembly 400 enables a circuit breaker housing 3 to accommodate a wide variety of circuit breaker component designs. For example and without limitation, it is the clam-shelled pivot assembly design which, in large part, enables the use of the solid conductor 52 of the conductor assembly 50, previously discussed in connection with FIGS. 1-3, and provides space to receive additional components such as, for example and without limitation, a sensor (not shown).

Figure 11:
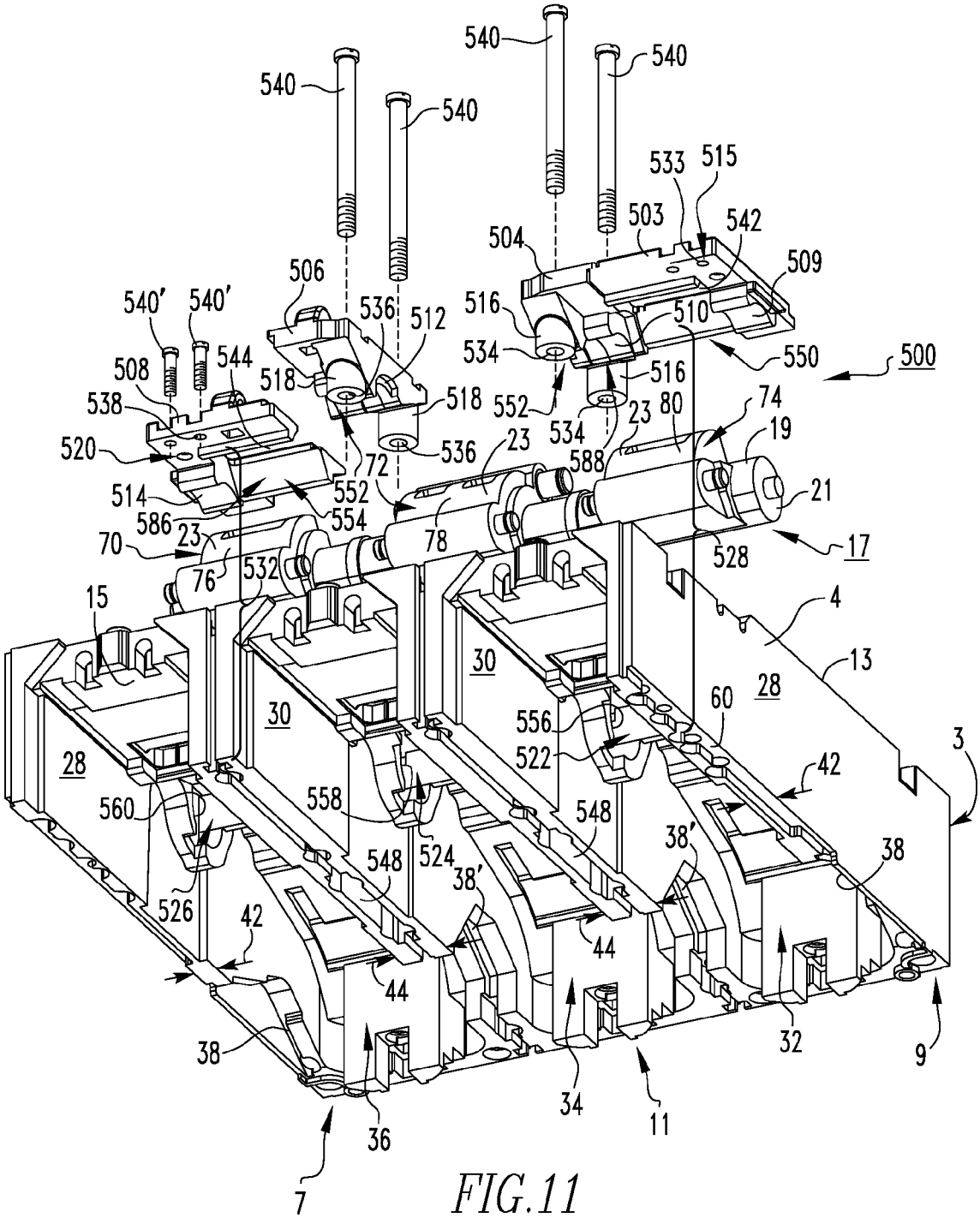
FIG. 11 is an isometric view of the underside of the molded cover of the circuit breaker and a portion of the pole shaft assembly therefor, of FIG. 1.

Continuing to refer to FIG. 9, the pivot assembly 400 for the three-pole low-voltage circuit 2 includes four pivot members 402,404, a pair of the aforementioned end pivot members 402 disposed at or about the first and second sides 7,9 of the circuit breaker housing 3, and a pair of the aforementioned intermediate pivot members 404 disposed between the end pivot members 402 at an intermediate portion 11 of the circuit breaker housing 3, as shown. More specifically, the tab 426 of each end pivot member 402 engages a corresponding recess 38 (best shown in FIGS. 1 and 9) of the molded base 5 of the circuit breaker housing 3 and the cut-out portions 430 and lateral extensions 424,425 of each end pivot member 402 are received within a corresponding recess 38 in the molded cover 4 of the circuit breaker housing 3, as best shown in FIG. 11, to clam-shell the end pivot members 402 between the molded cover 4 and molded base 5 of the circuit breaker housing 3, as previously discussed. Each intermediate pivot member 404 is similarly clam-shelled by the rib 422 of the intermediate pivot member 404 engaging a corresponding recess 38' of the molded cover 4 of the circuit breaker housing 3, as best shown in FIGS. 10 and 11, and the elongated recess 428 of the intermediate pivot member 404 receiving the corresponding protrusion 40 (e.g., without limitation, portion 40 of substantially vertical wall 26) of the molded base 5 of the circuit breaker housing 3.

In addition to the aforementioned advantages (e.g., without limitation, accommodation of manufacturing tolerance discrepancies; improved alignment between circuit breaker components), the pivot members 402,404 of the pivot assembly 400 also serve to provide a superior dielectric barrier 436 (FIGS. 9 and 10) between poles 18,20,22 (FIG. 9) of the circuit breaker 2, in order to electrically isolate one pole 18,20,22 from another. This advantage is afforded both by the aforementioned protrusion (e.g., rib 422) and recess (e.g., recess 38') closely fitting clam-shelled structure of the pivot assembly 400, which can best be appreciated with reference to the cross-sectional view of FIG. 10, and also to the fact that the first widths 432 (best shown in FIG. 7), 434 (best shown in FIG. 8) of the end pivot members 402 and intermediate pivot members 404 are greater than the second widths 42,44 (FIG. 9) of the walls 24,26 (FIG. 9), respectively, of the circuit breaker housing 3 (FIG. 9). Thus, it will be appreciated that the pivot members 402 are separate pieces, the increased widths 432,434 of which provide superior mechanical bearing support while simultaneously permitting widths 42,44 of the walls 24,26, for example, to be thinner, thereby providing increased interior space.

FIGS. 1 and 9-12 show another feature of the example low-voltage circuit breaker 2 (FIGS. 1, 9 and 10) which is structured to address and overcome the aforementioned manufacturing tolerance discrepancy and alignment issues among and between circuit breaker components (e.g., without limitation, stationary contact assembly; movable contact assembly; carrier assembly; operating mechanism) which result, for example, between a first circuit component (e.g., without limitation, stationary contact assembly; movable contact assembly; carrier assembly; operating mechanism) which is mounted to a first portion or section (e.g., without limitation, exterior side 13' of molded base 5 of FIG. 1) of one part (e.g., without limitation molded base 5) of the circuit breaker housing 3 and coupled to at least one other component (e.g., without limitation, stationary contact assembly; movable contact assembly; carrier assembly; operating mechanism) mounted to another portion or section (e.g., without limitation, interior side 15' of molded base 5 of FIG. 1) of the same part (e.g., without limitation, molded base 5). In other words, such issues result as a consequence of the parting line, as defined herein, of the individual component. It will, however, be appreciated that they also occur across the mating line, as defined herein, between separate components of the breaker 2 such as, for example and without limitation, the mating line between the first half (e.g., molded cover 4 of FIG. 1) of the circuit breaker housing (e.g., housing 3 of FIG. 1) and on the second half (e.g., molded base 5 of FIG. 1) of the housing (e.g., housing 3 of FIG. 1). Specifically, a bearing assembly 500 is employed which pivotably supports the pole shaft 19 of the circuit breaker operating mechanism 17 substantially independent of the mating line between the molded cover 4 and molded base 5 of the circuit breaker housing 3, and of the parting line(s) of any and all intermediate part(s) interposed therebetween. The bearing assembly 500 also pivotably couples and supports the pole shaft 19 on the same side of the parting line of the molded base 5 as the stationary contact assembly 10 of the circuit breaker 2. Accordingly, misalignment across the parting line and/or mating the line 60, which is/are prevalent in the known prior art, is substantially eliminated. In the example low-voltage circuit breaker 2 of FIG. 1, the pole shaft 19 is disposed substantially entirely outside of the molded cover 4 while being substantially supported on the molded base 5 of the circuit breaker housing 3. Such configuration of the pole shaft 19 is made possible by the bearing assembly 500 in accordance with embodiments of the invention, which will now be discussed. It will be appreciated that not all of the components of the bearing assembly 500 are shown in each of FIGS. 1 and 9-12. In particular, several components are not shown in FIGS. 9 and 10 which respectively show the bearing assembly 500 assembled, and a cross-section of a portion of the bearing assembly 500.

Figure 12:
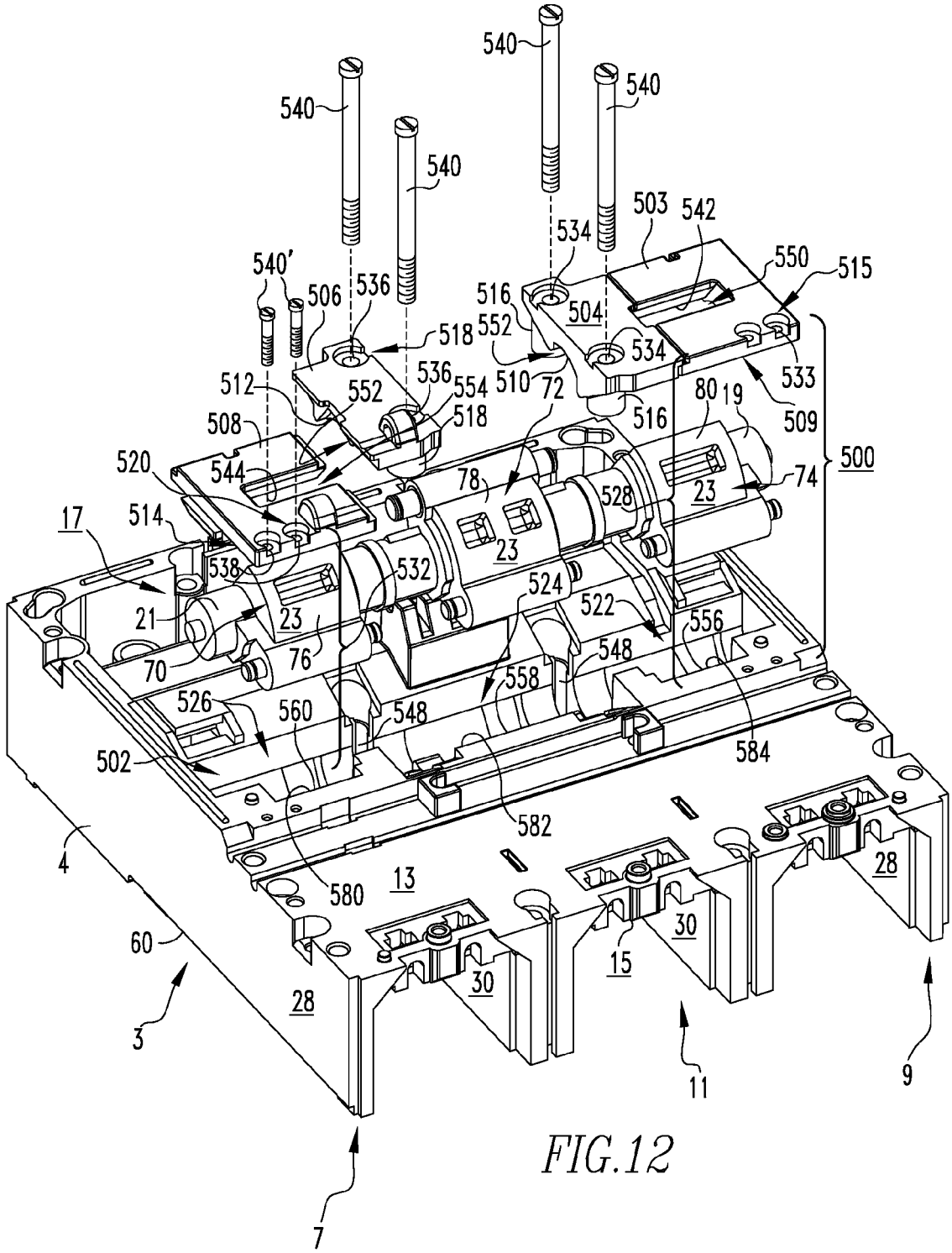
FIG. 12 is an isometric view of the top side of the molded cover of the circuit breaker and a portion of the pole shaft assembly therefor, of FIG. 1.

The bearing assembly 500 includes a number of primary bearings 530,531, (FIGS. 1 and 10), an integral bearing section 502 (not expressly shown in FIG. 9; best shown in FIG. 12), and at least one bearing cover member 503,504,506,508 (only one cover member 506 is shown in the cross-sectional view of FIG. 10). Each cover member 503,504,506,508 includes a bearing surface 509,510,512,514 and a fastening portion 515,516,518,520. The fastening portions 515,516, 518,520 are structured to couple the bearing cover members 503,504,506,508 to the molded cover 4 in order that the pole shaft 19 of the operating mechanism 17 is pivotably disposed between the integral bearing section 502 and the bearing surfaces 509,510,512,514 of the bearing cover members 503, 504,506,508 on the exterior side 13 of the molded cover 4, as best shown in FIGS. 9 and 12. More specifically, the integral bearing section 502 is "integral" in the sense that it comprises a plurality of molded portions 522,524,526 which are molded directly into the exterior surface 13 of the molded cover 4, as best shown in FIG. 12. It will, however, be appreciated that the pole shaft 19 could alternatively be pivotably disposed, for example and without limitation, on the exterior side 13' of the molded base 5 of the circuit breaker housing 3, without departing from the scope of the invention.

The molded portions 522,524,526 of the integral bearing section 502 generally comprise a number of molded first semi-circles 522,526 which are structured to receive the generally cylindrical shaft 21 of pole shaft 19, thereby forming the first part of a secondary pole shaft bearing 528,532. The second part of the secondary pole shaft bearing (two secondary pole shaft bearings 528,532 are shown in the example bearing assembly 500 illustrated and described herein) is formed by the bearing surface 509,514 of a corresponding bearing cover member 503,508 each of which comprises a second semi-circle 509,514. When the fastening portion 515, 516,518,520 of each bearing cover member 503,504,506,508 is coupled to the molded cover 4 of housing 3, each first semi-circle 522,526 of integral bearing section 502 aligns with the second semi-circle 509,514 of a corresponding one of the bearing cover members 503,508, in order to form the secondary pole shaft bearings 528,532.

More importantly, the pole shaft 19 is pivotably supported by the primary bearings 530,531. Specifically, the example bearing assembly 500 includes two primary bearings 530,531 which provide the primary support for the pole shaft 19. The primary bearings 530,531, as will be discussed herein, pivotably couple and support the pole shaft 19 on the same side (e.g., interior side 15') of the parting line of the molded base 5 as the stationary contact assembly 10 of the circuit breaker 2. In this manner, the disadvantages (e.g., without limitation, misalignment) commonly associate with the parting line(s) of each individual component or group of components, and the mating line(s) between components, are eliminated because the relationship between the pole shaft 19 and stationary contact assembly 10 does not cross the parting line(s) and/or mating line(s). This relationship can be best appreciated with reference to the cross-sectional view of FIG. 10, which shows primary bearing 530, in detail.

The example bearing assembly 500 includes four bearing cover members 503,504,506,508, a first molded bearing cover 503, a second molded bearing cover 504, a third molded bearing cover 506, and a fourth molded bearing cover 508. It will, however, be appreciated that any known or suitable number of bearing cover members having any known or suitable configuration could alternatively be employed. For example and without limitation, a single-piece bearing cover member (not shown) could be used. The fastening portions 515,516,518,520 of the example first, second, third and fourth molded bearing cover members 503,504,506,508 respectively include at least one opening 533,534,536,538 and fasteners, such as the screws 540,540' which are shown. The screws 540,540' are inserted through the corresponding openings 533,534,536,538 and are tightened to secure the corresponding bearing cover members 503,504,506,508 to the exterior side 13 of the molded cover 4 of circuit breaker molded housing 3. It will, however, be appreciated that any known or suitable alternative fastening mechanism other than the example fasteners 540,540' shown and described herein, could be employed. The molded cover members 503,504, 506,508 and the remainder of the bearing assembly 500 are shown assembled in FIG. 9 (shown without fasteners 540, 540'; see also FIG. 10 showing fasteners 540).

As previously noted, the pole shaft 19 comprises a generally cylindrical shaft 21. The generally cylindrical shaft 21 includes a plurality of levers 23 extending generally outwardly therefrom, as shown in FIGS. 1 and 10-12. In order to accommodate movement of such levers 23, each of the bearing cover members 503,504,506,508 further includes a plurality of first molded passages 550,552,554 structured to permit pivoting of the pole shaft 19 and, in particular, levers 23 of the pole shaft 19. Likewise, the integral bearing section 502 includes a plurality of second molded passages 556,558,560 for receiving the levers 23 when the pole shaft 19 pivots. The example pole shaft 19 includes three levers 23 protruding outwardly from the generally cylindrical shaft 21. The three levers 23 are respectively accommodated by three first molded passages 550,552,554 in the first, second and third molded bearing cover members 504,506,508 and three corresponding second molded passages 556,558,560 in the integral bearing section 502 of the bearing assembly 500.

At least one of the bearing cover members 503,504,506, 508 additionally includes at least one aperture 542,544 for providing access to a portion of the pole shaft 19 from the exterior side 13 of the molded cover 4 when the bearing assembly 500 is assembled, as best shown in FIG. 9. In this manner, at least partial access to the pole shaft 19 is provided in order to, for example and without limitation, sense or view the position of the pole shaft 19, inspect, and/or maintain (e.g., without limitation, lubricate) the pole shaft 19 without requiring the entire bearing assembly 500 to be disassembled. Hence, because the bearing assembly 500 is substantially disposed on the exterior side 13 of the circuit breaker housing 3 and substantially entirely on one side of the mating line 60 of the circuit breaker housing 3, as opposed to being disposed at or about the mating line 60 between the molded cover 4 and molded base 5 of the housing 3, as is sometimes the case in the known prior art, the bearing assembly 500 and pole shaft 19 can be relatively easily accessed from the exterior side 13 of the housing 3 without having to entirely separate the molded cover 4 and molded base 5. The example bearing assembly 500 includes two apertures 542,544 in the first molded bearing cover member 503 and fourth molded bearing cover member 508, respectively, although it will be appreciated that any known or suitable number of apertures, or that no apertures whatsoever, could be employed without departing from the scope of the invention. It will also be appreciated that the apertures 542,544, in addition to serving the aforementioned access function for providing access to pole shaft 19, can also serve to further accommodate pivotable motion of the aforementioned levers 23 of the pole shaft 19.

As previously discussed, the example bearing assembly 500 includes two primary bearings 530,531. The first half of each primary bearing 530,531 (one primary bearing 530 is best shown in FIG. 10) comprises a molded extension 546 of the molded base 5 of the circuit breaker housing 3. Specifically, the molded cover 4 and molded base 5 each further include an interior side 15',15 and, as discussed previously, substantially vertical walls 24,26,28,30 extend outwardly from the interior side 15',15 of the molded cover 4 and molded base 5, respectively. The molded extensions 546, two of which are shown in the example bearing assembly 500 of FIGS. 1 and 9, comprise molded extensions 546 of the substantially vertical walls 26 of the molded cover 4 (best shown in FIG. 10). As best shown in FIG. 10, the molded extension 546 is coupled to a corresponding one of the integral bearing cover members 506 of the bearing assembly 500 proximate a corresponding one of the molded portions (e.g., molded portion 524 of FIG. 10) thereof in order to support the pole shaft 19 of the operating mechanism 17. The bearing cover member 506, thus serves as the second half of the integral bearing 530.

A corresponding substantially vertical wall 30 of the molded cover 4 of housing 3 includes a molded recess 548 (best shown in FIG. 11) structured to receive the molded extension 546 of substantially vertical wall 26 of the molded base 5, as shown in FIG. 10, and the aforementioned fasteners 540 (one fastener 540 is shown in FIG. 10) are inserted through opening 536 of the bearing cover member 506 and into a corresponding opening 537 of the molded extension 546. The fastener 540 then engages a second fastening mechanism 541, such as, for example and without limitation, a threaded component (e.g., without limitation, a nut), and is tightened to secure the bearing assembly 500 together. It will, however, be appreciated that any other known or suitable fastening mechanism other than the pair of fastening components 540,541 which are shown, could be employed without departing from scope of the invention.

Accordingly, the bearing assembly 500 provides a cost effective mechanism for addressing and overcoming alignment issues with respect to different portions or sections of the same component(s) (e.g., across the parting line(s)) of the circuit breaker 2, and/or between the various separate components (e.g., across the mating line(s)) of the circuit breaker 2. The bearing assembly 500 also provides for relatively easy assembly and access of the circuit breaker pole shaft 19, for example, for inspection and/or maintenance, without requiring complete disassembly of the entire circuit breaker 2.

As will now be discussed with respect to FIGS. 13A, 13B, 13C, 14A, 14B and 14C, the bearing assembly 500, which for purposes of the following discussion will be referred to simply as the pole shaft assembly 500, also provides an advantageous seal arrangement between the pole shaft 19 and the circuit breaker housing 3, for example, in order to resist the undesired entry of debris into the circuit breaker 2, and to control the discharge of arc gases 48 (shown in simplified form in FIG. 13A). More specifically, when the circuit breaker 2 is energized and the separable contacts 12,130 (shown in simplified form in FIG. 13A) are rapidly opened, for example, in response to an electrical fault condition, an arc 46 (shown in simplified form in FIG. 13A) is created. The arc 46 generates the arc gases 48, which must be dissipated and/or discharged from the circuit breaker 2. It is desirable to control the discharge of (e.g., without limitation, restrict flow so as to avoid a shock wave) such arc gases 48 from the circuit breaker 2. It is also desirable to resist the undesired entry of debris (e.g., without limitation, plasma material; molten and/or vaporized metal; combustion products, such as carbon) into the circuit breaker housing 3 and, in particular, at or about the pole shaft 19. As will be discussed, the pole shaft 19 of the disclosed pole shaft assembly 500 is "self-sealing," in order to accomplish these objectives.

Specifically, the pole shaft assembly 500 includes a receiving portion 502 (sometimes referred to hereinabove as an integral bearing section 502), which is disposed on the exterior side 13 of the housing 3. In the example shown and described herein, the receiving portion 502 (see, also, FIG. 9) is a molded recess in the exterior side 13 of the molded cover 4 of the circuit breaker housing 3. The pole shaft 19 is pivotably disposed within the receiving portion 502, and includes at least one protrusion 70,72,74. A number of cover members 504,508 (sometimes referred to hereinabove as bearing cover members 504,508) overlay the pole shaft 19 and the receiving portion 502 (see also, for example, the assembled isometric view of FIG. 9). At least one first seal 570 (FIGS. 13B and 14B), 572 (FIGS. 13A and 14A), 574 (FIGS. 13C, 14C) is disposed between the receiving portion 502 and a corresponding one of the protrusions 70 (FIG. 13B), 72 (FIG. 13A), 74 (FIG. 13C). At least one second seal 576 (FIG. 13B), 578 (FIG. 13C) is disposed between at least one of the protrusions 70 (FIG. 13B), 72 (FIG. 13A), 74 (FIG. 13C) and a corresponding one of the cover members 504 (FIGS. 13A, 13C, 14A and 14C), 508 (FIGS. 13B and 14B). The seals (e.g., 570,572,574,576,578) resist the undesired entry of debris between the receiving portion 502 and the pole shaft 19, and control the discharge of arc gases 48 (FIGS. 13A, 13B and 13C) from the circuit breaker 2, as previously discussed.

As will now be discussed in greater detail, the example pole shaft assembly 500 includes three first seals 570,572,574, which are primary seals formed by the interaction between the receiving portion 502 and the corresponding protrusion 70,72,74. The example pole shaft assembly 500 also includes two second seals 576,578, which are secondary seals formed by the interaction between the protrusion 70,72,74 and the corresponding cover member 504,508. More specifically, as best shown in FIGS. 1 and 9, the example circuit breaker 2 includes three poles, a first pole 18, a second pole 20, and a third pole 22. It will, however, be appreciated that the circuit breaker (e.g., 2) could have any known or suitable number of poles. For example and without limitation, it could include four poles (not shown), wherein the fourth pole (not shown) would be similar to the first pole 18 or the third pole 22. The pole shaft 19, is structured to extend perpendicularly across the poles 18,20,22, as shown in FIG. 1. Also shown in FIG. 1, is that the protrusion(s) of the example pole shaft 19 include a first lobe 70 extending outwardly from the pole shaft 19 at the first pole 18, a second lobe 72 extending outwardly from the pole shaft 19 at the second pole 20, and a third lobe 74 extending outwardly from the pole shaft 19 at the third pole 22. Each of the first, second and third lobes 70,72,74 includes a surface 76,78,80, respectively, which in the example shown and described herein is arcuate shaped. The arcuate shape serves a number of advantageous functions. Among them is the fact that it maintains the seal (e.g., 570,572,574) throughout the full range of motion of the pole shaft 19. It also provides strength in the direction of mechanical loading on the lobes 70,72,74 of the pole shaft 19.

Continuing to refer to FIG. 1, and also to FIG. 12, the example receiving portion 502 includes a first surface 580 at the first pole 18, a second surface 582 at the second pole 20, and a third surface 584 at the third pole 22. Such surfaces 580,582,584 are preferably molded segments of the exemplary molded recess 502. The example circuit breaker 2 also includes as the number of cover members, a plurality of covers 503,504,506,508, although it will be appreciated that any known or suitable alternative number and/or configuration (not shown) of covers could be employed, without departing from the scope of the invention. A first one of the covers, 508, overlays the first lobe 70 of the pole shaft 19 at or about the first pole 18, and includes a surface 586 (FIGS. 13B and 14B). A second one of the covers, 504, overlays the third lobe 74 of the pole shaft 19 at or about the third pole 22, and includes a surface 588 (FIGS. 13C and 14C). In the example shown and described herein, no cover member directly overlays the second lobe 72 of the pole shaft 19, although it will be appreciated that the second lobe 72 could also be overlayed within the scope of the invention.

Figure 13A:
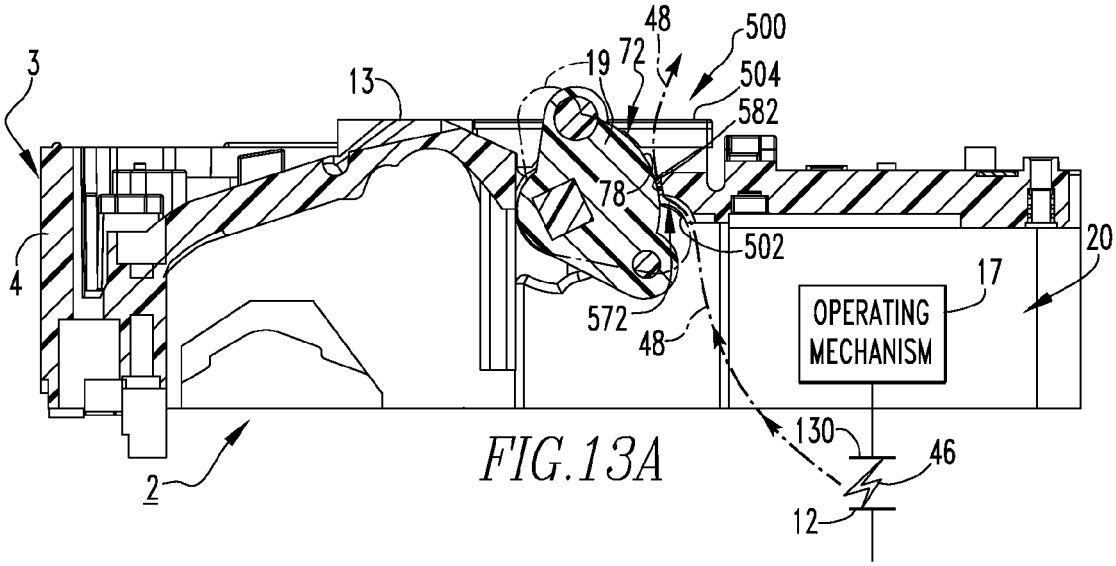
FIGS. 13A, 13B and 13C are sectional views taken along lines 13A-13A, 13B-13B and 13C-13C, respectively, of FIG. 9, showing the pole shaft assembly moving toward the position corresponding to the separable contacts of the circuit breaker being open, such position being shown in phantom line drawing.
Figure 13B:
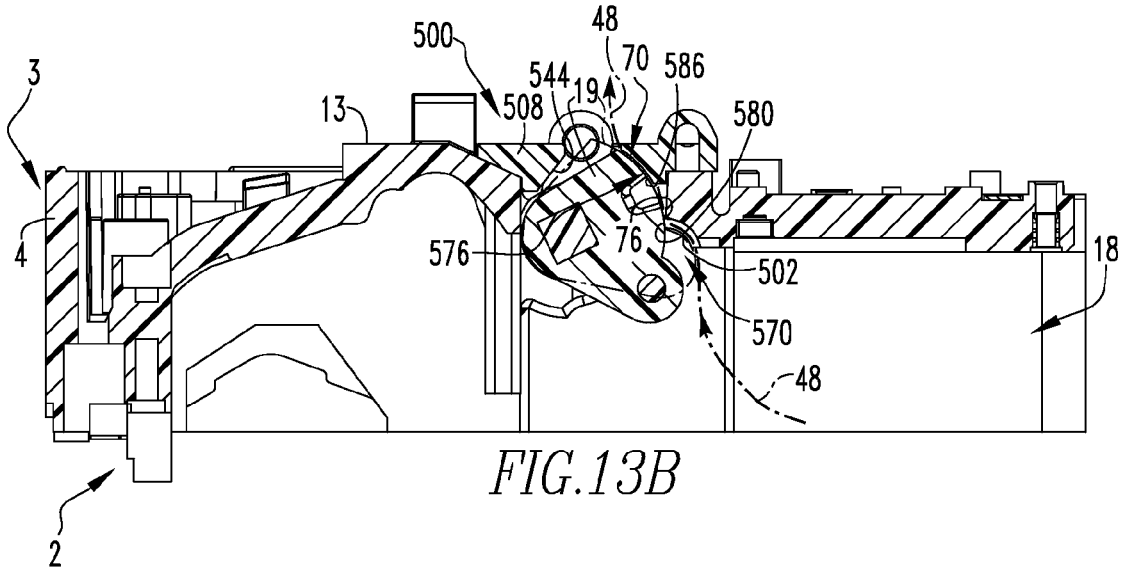
Figure 13C:
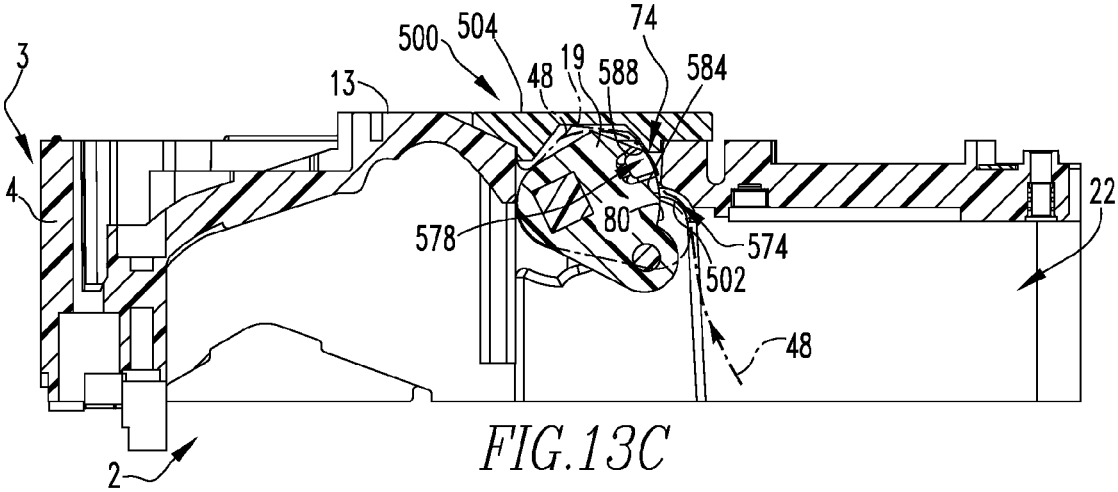
Figure 14A:
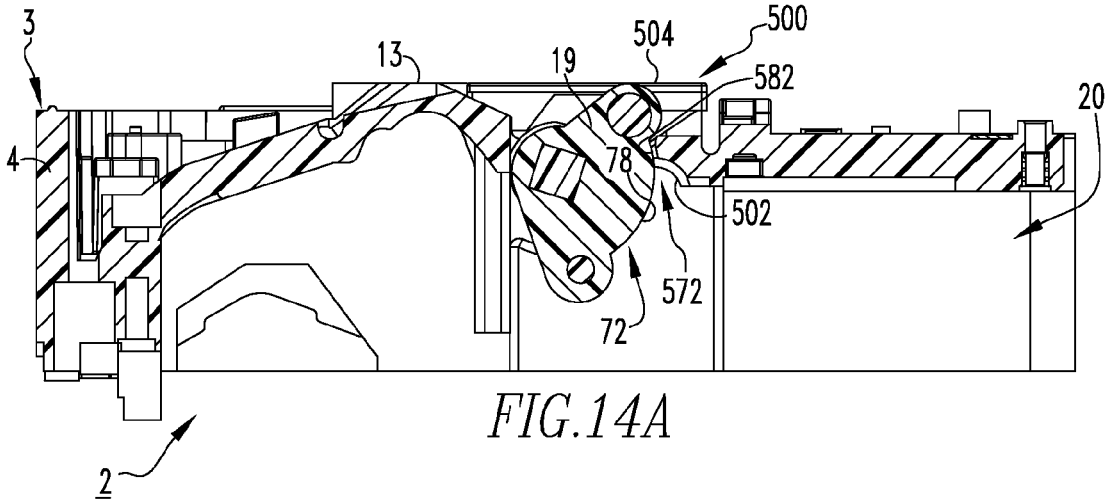
FIGS. 14A, 14B and 14C are side elevation, sectional views of the circuit breaker and pole shaft assembly of FIGS. 13A, 13B and 13C, respectively, but modified to show the pole shaft assembly in the position corresponding to the separable contacts of the circuit breaker being closed.
Figure 14B:
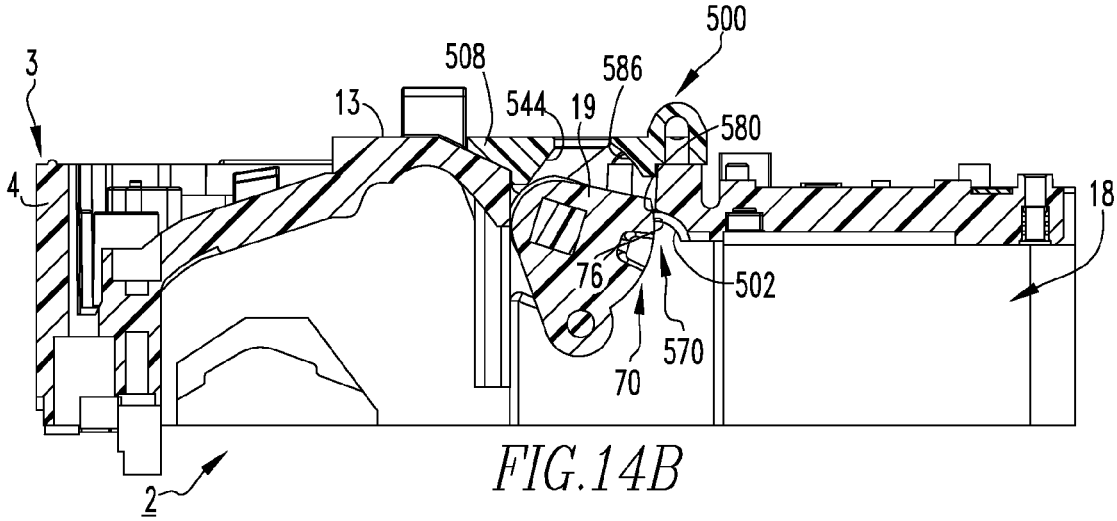
Figure 14C:
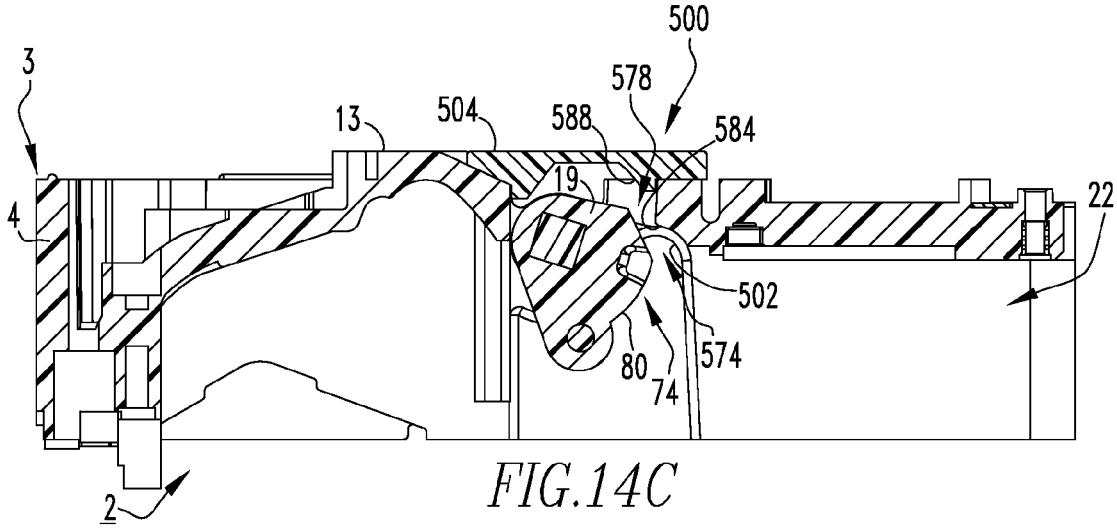

Accordingly, it will be appreciated that the disclosed pole shaft assembly 500 includes a primary seal 570 for the first pole 18, as shown in FIGS. 13B and 14B, a primary seal 572 for the second pole 20, as shown in FIGS. 13A and 14A, and a primary seal 574 for the third pole 22, as shown in FIGS. 13C and 14C. The example pole shaft assembly 500 further includes a secondary seal 576 for the first pole 18, as shown in FIG. 13B, and a secondary seal 578 for the third pole 22, as shown in FIG. 13C. More specifically, referring to FIG. 13B, it will be appreciated that the primary seal 570 of the first pole 18 is disposed between surface 76 of the first lobe 70, and the first surface 580 of the receiving portion 502. The secondary seal 576 of the first pole 18 is disposed between surface 76 of the first lobe 70, and surface 586 of the first cover 508. Similarly, referring to FIGS. 13A and 14A, it will be appreciated that the primary seal 572 of the second pole 20 of the example circuit breaker 2 is disposed between surface 78 of the second lobe 72 and the second surface 582 of the receiving portion 502 and, referring to FIGS. 13C and 14C, it will be appreciated that the primary seal 574 of the third pole 22 is disposed between surface 80 of the third lobe 74 and the third surface 584 of the receiving portion 502. The secondary seal 578 of the third pole 22, shown in FIG. 13C, is disposed between surface 80 of the third lobe 74 and surface 588 of the second cover 504.

Operation of the pole shaft 19 from the open position (shown in phantom line drawing) of FIGS. 13A, 13B and 13C to the closed position of FIGS. 14A, 14B and 14C, and the effect that movement of the pole shaft 19 from such open position (FIGS. 13A, 13B and 13C) to such closed position (FIGS. 14A, 14B and 14C) has on the primary seals 570 (FIGS. 13B and 14B), 572 (FIGS. 13A and 14A), 574 (FIGS.

13C and 14C) and secondary seals 576 (FIG. 13B), 578 (FIG. 13C), will now be discussed. Specifically, when the example pole shaft 19 is disposed in the first (e.g., open) position, shown in phantom line drawing, the first pole 18 maintains both the primary seal 570, which is disposed between surface 76 of the first lobe 70 and the first surface 580 of the receiving portion 502, and the secondary seal 576, which is disposed between surface 76 of the first lobe 70 and the first cover 508, as shown in FIG. 13A. When the example pole shaft 19 moves to the second, closed position of FIG. 14B, the first pole 18 maintains the primary seal 570, but surface 76 of the first lobe 70 separates from the first cover 508, thereby unsealing the secondary seal 576 (FIG. 13B) of the first pole 18, as shown. The second pole 20 maintains the primary seal 572, which is disposed between surface 78 of the second lobe 72 and the second surface 582 of the receiving portion 502, when the pole shaft 19 is disposed in the first or open position of FIG. 13A, and when the pole shaft 19 is disposed in the second position of FIG. 14A. When the pole shaft 19 is disposed in the first position, the third pole 22 maintains both the primary seal 574, which is disposed between surface 80 of the third lobe 74 and the second cover 504, and the secondary seal 578, which is disposed between surface 80 of the third lobe 74 and the third surface 584 of the receiving portion 502, as shown in FIG. 13C. When the pole shaft 19 moves toward the second or closed position of FIG. 14C, the third pole 22 maintains the primary seal 574, but surface 80 of the third lobe 74 separates from the second cover 504 thereby unsealing the secondary seal 578 of the third pole 22, as shown. It will, however, be appreciated that the above unsealing effect of the example secondary seals 576 (FIG. 13B), 578 (FIG. 13C) is an incidental occurrence that results when the pole shaft 19 is fully closed (FIGS. 14A, 14B and 14C) and sealing is not as important in the absence of arcing. Embodiments (not shown) in which both the primary and secondary seals 570,572,574 and 576,578 are maintained through the full range of motion of the pole shaft 19 are also contemplated by the invention.

When the pole shaft 19 is disposed in the first position and the arc gases 48 in (FIGS. 13A, 13B and 13C) are generated by the separable contacts 12,130 (FIG. 13A) opening and forming the arc 46 (FIG. 13A), the sealing afforded by the disclosed pole shaft assembly 500 is at its best. Specifically, the lower (from the perspective of FIGS. 13A, 13B and 13C) linkage arms of the lobes 70,72,74 of the pole shaft 19 fit within the corresponding coves of the receiving portion 502, as shown in phantom line drawing. Thus, the pole shaft assembly 500 requires the arc gases 48 to pass through both the primary seal 570 and the secondary seal 576 of the first pole 18, before exiting the circuit breaker housing 3, as shown in simplified form in FIG. 13B. In this manner, the seals (e.g., without limitation, 570,576) of the disclosed pole shaft assembly 500 create a "labyrinth" (e.g., indirect passageway) through which the arc gases 48 must pass. Accordingly, in addition to performing a sealing function, for example, in order to resist the undesired entry of debris (e.g., without limitation, molten metal particles) at or about the pole shaft 19, the seals (e.g., 570,576) of the pole shaft assembly 500 also serve to control the discharge of the arc gases 48 from the circuit breaker 2, and/or to cool and dissipate such gases 48 by requiring them to pass through the aforementioned labyrinth. Similarly, as shown in FIG. 13C, the arc gases 48 are directed through both the primary seal 574 and the secondary seal 578 of the third pole 22. Furthermore, in the example of FIG. 13C, the cover 504 does not include a hole therethrough. Hence, the arc gases 48 are maintained within the circuit breaker housing 3 at or about the third pole 22, in order to be cooled and dissipated therein, or alternatively to continue to flow around the pole shaft 19 and be discharged from another location of the circuit breaker housing 3 (not expressly shown). It will, however, be appreciated that in other embodiments of the invention, the cover 504 for the third pole 22 could have an opening (not shown) extending therethrough similar to the opening 544 through cover 508 for the first pole 18 of FIG. 13B. It will further be appreciated that while the example circuit breaker 2 includes three poles 18,20,22 and the example pole shaft 19 is a single-piece of material having three lobes 70,72,74 extending outwardly from the pole shaft 19 at or about each of the poles 18,20,22 of the circuit breaker 2, that the circuit breaker 2 and/or pole shaft 19 therefor could respectively include any known or suitable alternative number and/or configuration of poles (not shown) and/or lobes or other suitable protrusions (not shown). It will also be appreciated that the pole shaft assembly 500 could comprise known or suitable alternative number and/or configuration of seals (e.g., primary seals 570 (FIGS. 13B and 14B), 572 (FIGS. 13A and 14A), 574 (FIGS. 13C and 14C) and secondary seals 576 (FIG. 13B), 578 (FIG. 13C)) for the poles (e.g., 18,20,22) of the circuit breaker 2.

Accordingly, the disclosed pole shaft assembly 500 provides a mechanism that is self-sealing in that no separate structure is required between the pole shaft 19 and the receiving portion 502, or between the pole shaft 19 and the corresponding cover member 504,508, in order to form the seals 570,572,574,576,578 of the pole shaft assembly 500. In other words, each of the primary seals 570,572,574 is formed solely by the interaction of the pole shaft 19 (e.g., surface 76,78,80 of lobes 70,72,74, respectively) and the receiving portion 502 (e.g., first, second, and third surfaces 580,582,584) of the circuit breaker housing 3. Likewise, the secondary seals 576, 578 are formed solely by the interaction of the pole shaft 19 (e.g., surfaces 76,80 of the lobes 70,74, respectively) and the corresponding covers 508,504 (e.g., surfaces 586,588, respectively) without requiring a separate structure (e.g., without limitation, a gasket; a bearing; a sleeve) therebetween. Thus, the disclosed pole shaft assembly 500 effectively seals and protects the pole shaft 19, for example, from debris (e g., without limitation, molten metal particles) and controls the discharge of arc gases 48, while minimizing the number of components required for the pole shaft assembly 500, and thereby reducing the complexity and cost associated therewith.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A pole shaft assembly for an electrical switching apparatus including a housing having an exterior side, separable contacts enclosed by said housing, and an operating mechanism structured to open and close said separable contacts, which are structured to create an arc that generates are gases when said separable contacts open, said pole shaft assembly comprising:

a receiving portion structured to be disposed on the exterior side of said housing;

a pole shaft pivotably disposed within said receiving portion and including at least one protrusion;

a number of cover members overlaying said pole shaft and said receiving portion;

at least one first seal being disposed between said receiving portion and a corresponding one of said at least one protrusion;

at least one second seal disposed between at least one of said at least one protrusion and a corresponding one of said number of cover members;

wherein said at least one first seal and said at least one second seal are structured to resist undesired entry of debris between said receiving portion and said pole shaft, and further to control the discharge of said arc gases from said electrical switching apparatus;

wherein sealing activity occurs by the interaction between said receiving portion and said corresponding one of said at least one protrusion;

wherein sealing activity occurs by the interaction between said at least one of said at least one protrusion and said corresponding one of said number of cover members;

wherein said electrical switching apparatus further includes a number of poles; and wherein said pole shaft is structured to extend perpendicularly across said number of poles;

wherein said number of poles is a first pole, a second pole, and a third pole; wherein said at least one protrusion of said pole shaft is a first lobe extending outwardly from said pole shaft at said first pole, a second lobe extending outwardly from said pole shaft at said second pole, and a third lobe extending outwardly from said pole shaft at said third pole; and wherein each of said first lobe, said second lobe, and said third lobe includes a surface;

wherein said receiving portion comprises a first surface at said first pole, a second surface at said second pole, and a third surface at said third pole; wherein said number of cover members is a plurality of covers; wherein a first one of said covers overlays said first lobe of said pole shaft at or about said first pole and includes a surface; and wherein a second one of said covers overlays said third lobe of said pole shaft at or about said third pole and includes a surface; and wherein said pole shaft is structured to pivot among a first position corresponding to said separable contacts being open, and a second position corresponding to said separable contacts being closed; wherein, when said pole shaft is disposed in said first position, said first pole maintains both said primary seal of said first pole, which is disposed between said surface of said first lobe and said first surface of said receiving portion, and said secondary seal of said first pole, which is disposed between said surface of said first lobe and said first one of said covers; wherein, when said pole shaft is disposed in said second position, said first pole maintains said primary seal of said first pole but said surface of said first lobe is separated from said first one of said covers thereby unsealing said secondary seal of said first pole; wherein said second pole maintains said primary seal of said second pole, which is disposed between said surface of said second lobe and said second surface of said receiving portion, when said pole shaft is disposed in said first position and when said pole shaft is disposed in said second position; wherein, when said pole shaft is disposed in said first position, said third pole maintains both said primary seal of said third pole, which is disposed between said surface of said third lobe and said second one of said covers, and said secondary seal of said third pole, which is disposed between said surface of said third lobe and said third surface of said receiving portion; and wherein, when said pole shaft is disposed in said second position, said third pole maintains said primary seal of said third pole but said surface of said third lobe is separated from said second one of said covers thereby unsealing said secondary seal of said third pole.

2. The pole shaft assembly of claim 1 wherein, when said pole shaft is disposed in said first position and said arc gases are generated by said separable contacts opening, said first pole is structured to direct said arc gases through both said primary seal of said first pole and said secondary seal of said first pole, and said third pole is structured to direct said arc gases through both said primary seal of said third pole and said secondary seal of said third pole, before said arc gases exit said housing.

3. An electrical switching apparatus comprising:

a housing including an exterior side;

separable contacts enclosed by said housing;

an operating mechanism structured to open and close said separable contacts, which are structured to create an arc that generates arc gases when said separable contacts open;

a pole shaft assembly comprising:

a receiving portion disposed on the exterior side of said housing;

a pole shaft pivotably disposed within said receiving portion and including at least one protrusion;

a number of cover members overlaying said pole shaft;

at least one first seal being disposed between said receiving portion and a corresponding one of said at least one protrusion;

at least one second seal disposed between at least one of said at least one protrusion and a corresponding one of said number of cover members;

wherein said at least one first seal and said at least one second seal resist undesired entry of debris between said receiving portion and said pole shaft, and control the discharge of said arc gases from said electrical switching apparatus;

wherein sealing activity occurs by the interaction between said receiving portion and said corresponding one of said at least one protrusion;

wherein sealing activity occurs by the interaction between said at least one of said at least one protrusion and said corresponding one of said number of cover members;

wherein said operating mechanism of said electrical switching apparatus further includes a number of poles; and wherein said pole shaft of said pole shaft assembly extends perpendicularly across said number of poles;

wherein said number of poles is a first pole, a second pole, and a third pole; wherein said at least one protrusion of said role shaft is a first lobe extending outwardly from said pole shaft at said first pole, a second lobe extending outwardly from said pole shaft at said second pole, and a third lobe extending outwardly from said pole shaft at said third pole; and wherein each of said first lobe, said second lobe, and said third lobe includes a surface;

wherein said receiving portion of said pole shaft assembly comprises a first surface at said first pole, a second surface at said second pole, and a third surface at said third pole; wherein said number of cover members of said pole shaft assembly is a plurality of covers; wherein a first one of said covers overlays said first lobe of said pole shaft at or about said first pole and includes a surface; and wherein a second one of said covers overlays said third lobe of said pole shaft at or about said third pole and includes a surface; and wherein said pole shaft of said pole shaft assembly is pivotable among a first position corresponding to said separable contacts being open, and a second position corresponding to said separable contacts being closed; wherein, when said pole shaft is disposed in said first position, said first pole maintains both said primary seal of said first pole, which is disposed between said surface of said first lobe and said first surface of said receiving portion, and said secondary seal of said first pole, which is disposed between said surface of said first lobe and said first one of said covers; wherein, when said pole shaft is disposed in said second position, said first pole maintains said primary seal of said first pole but said surface of said first lobe is separated from said first one of said covers thereby unsealing said secondary seal of said first pole; wherein said second pole maintains said primary seal of said second pole, which is disposed between said surface of said second lobe and said second surface of said receiving portion, when said pole shaft is disposed in said first position and when said pole shaft is disposed in said second position; wherein, when said pole shaft is disposed in said first position, said third pole maintains both said primary seal of said third pole, which is disposed between said surface of said third lobe and said second one of said covers, and said secondary seal of said third pole, which is disposed between said surface of said third lobe and said third surface of said receiving portion; and wherein, when said pole shaft is disposed in said second position, said third pole maintains said primary seal of said third pole but said surface of said third lobe is separated from said second one of said covers thereby unsealing said secondary seal of said third pole.

4. The electrical switching apparatus of claim 3 wherein, when said pole shaft of said pole shaft assembly is disposed in said first position and said arc gases are generated by said separable contacts opening, said first pole directs said arc gases through both said primary seal of said first pole and said secondary seal of said first pole, and said third pole directs said arc gases through both said primary seal of said third pole and said secondary seal of said third pole, before said arc gases exit said housing.

* * * * *